US008544181B2

(12) United States Patent
Detournay

(10) Patent No.: US 8,544,181 B2
(45) Date of Patent: Oct. 1, 2013

(54) METHOD AND APPARATUS FOR MODELLING THE INTERACTION OF A DRILL BIT WITH THE EARTH FORMATION

(75) Inventor: Emmanuel Detournay, Roseville, MN (US)

(73) Assignee: Commonwealth Scientific & Industrial Research Organisation, Campbell (AU)

( * ) Notice: Subject to any disclaimer, the term of this patent is extended or adjusted under 35 U.S.C. 154(b) by 770 days.

(21) Appl. No.: 12/449,625

(22) PCT Filed: Feb. 20, 2008

(86) PCT No.: PCT/AU2008/000223

§ 371 (c)(1),
(2), (4) Date: Jun. 23, 2010

(87) PCT Pub. No.: WO2008/101285

PCT Pub. Date: Aug. 28, 2008

(65) Prior Publication Data

US 2010/0324825 A1 Dec. 23, 2010

(30) Foreign Application Priority Data

Feb. 20, 2007 (AU) ..... 2007900848

(51) Int. Cl.
*E21B 47/022* (2012.01)

(52) U.S. Cl.
USPC ..... 33/313; 33/303

(58) Field of Classification Search
USPC ..... 33/301, 302, 303, 313
See application file for complete search history.

(56) References Cited

U.S. PATENT DOCUMENTS

| | | | | |
|---|---|---|---|---|
| 4,479,564 | A | 10/1984 | Tanguy | |
| 4,662,458 | A | 5/1987 | Ho | |
| 4,739,841 | A | 4/1988 | Das | |
| 4,804,051 | A | 2/1989 | Ho | |
| 5,012,412 | A * | 4/1991 | Helm | 33/302 |
| 2005/0150689 | A1 | 7/2005 | Jogi et al. | |
| 2005/0165589 | A1 | 7/2005 | Huang | |
| 2009/0287451 | A1 * | 11/2009 | Sato et al. | 33/313 |
| 2010/0089572 | A1 * | 4/2010 | Chang et al. | 33/313 |

OTHER PUBLICATIONS

International Search Report for PCT/AU2008/000223 mailed Jun. 2, 2008.
Written Opinion for PCT/AU2008/000223 mailed Jun. 2, 2008.
Written Opinion for PCT/AU2008/000223 mailed Mar. 31, 2009.
International Preliminary Report on Patentability for PCT/AU2008/000223 completed Jul. 6, 2009.

* cited by examiner

*Primary Examiner* — G. Bradley Bennett
(74) *Attorney, Agent, or Firm* — Nixon & Vanderhye, PC

(57) ABSTRACT

A method of predicting a well trajectory wherein the method utilises a series of parameters to calculate the trajectory. The method is characterised in that the parameters include the angle of a drill bit (23) relative to a well bore (27), and the variation of said angle during drilling wherein the variation of said angle is related to the moment on the bit (23).

19 Claims, 17 Drawing Sheets

METHOD AND APPARATUS FOR MODELLING THE INTERACTION OF A DRILL BIT WITH THE EARTH FORMATION

This application is the U.S. national phase of International Application No. PCT/AU2008/000223 filed 20 Feb. 2008 which designated the U.S. and claims priority to Australian Patent Application No. 2007900848 filed 20 Feb. 2007, the entire contents of each of which are hereby incorporated by reference.

FIELD OF THE INVENTION

The present invention generally relates to directional drilling of wells in the oil and gas industry. In particularly the invention relates to improving the predictability of well trajectory as the well evolves.

BACKGROUND ART

As well paths in exploration and extraction activities in mining industries become increasingly longer and the network more complicated, new challenges are constantly being faced in the area of well drilling.

The cost of drilling a well is generally dependent on time—the longer it takes to drill the well the more expensive are the well establishment costs. It is therefore highly desirable to establish a well in the shortest time possible.

A major factor which contributes to the cost of a well relates to the well trajectory i.e. the path the bore will take between the surface and the reservoir. Whilst the length of the required path is set, optimizing the actual well trajectory to follow the desired path is of great importance.

Wells can often be thousands of metres long and require drilling through earth formations which can vary greatly in relation to their geological properties. Furthermore the forces that are placed on the drill bit, and those experienced by the bottom-hole assembly (BHA) and the whole drill string affect the evolution of the bore. These factors cause the actual trajectory of the well to deviate from the desired trajectory requiring the operators to constantly monitor the trajectory and often make corrections to the drilling direction. Such corrections can be made using a remotely controlled steerable system. However, these systems require further consideration by the drilling operators.

In worst case scenario, if it is not possible to correct the trajectory, the well must be plugged and restarted. Furthermore, an inaccurate trajectory can also result in loss of the drill string.

Corrections obviously affect the uniformity of the well, creating crookedness/dog legs, side tracks and overgauging of the bore diameter. This not only increases the time taken to drill the well but also creates problems when inserting and fixing casings within the well and alters the shape of the well wall. All these factors add to the expense of drilling the well, and may reduce the performance and life of the well.

As directional drilling has become more important over recent times various models and methods of gauging the actual trajectory of a drill bit have been developed. To date these methods assist in predicting and monitoring well trajectory but still require further corrective manipulation to provide worthwhile results.

Prediction of well trajectory, design of bottom-hole assembly (BHA), and control of rotary steerable systems must rely on a mathematical model to quantify the parameters which affects the borehole trajectory. The model accounts for:

- the elastic response of the drill string,
- contacts between the stabilizers (and possibly other parts of the BHA and the drill pipes) and the borehole wall, and
- the interaction between the bit and the rock.

As a result of the large number of parameters involved in the drilling process this model turns out to be non-classical, in particular in view of the bit-rock interaction. Whilst not all parameters have a significant effect on the trajectory it is so far not certain which parameters must be considered in order to accurately predict the actual well trajectory. Certainly the prior art models do provide useful theoretical predictions, however, trajectory inaccuracies still occur when drilling the well.

When drilling, a drill bit is forced to engage and cut into the rock by the weight acting on the bit, with the debris removed by the injection of high pressure drilling fluid through the bit. Drill bits come in a multitude of configurations to suit different conditions. However, information regarding the behavior of the bit is not readily available and therefore it is difficult to incorporate the drill bit behavior and its interaction with respect to the rock when planning and drilling the well.

A vast proportion of current methods and models consider the weight and forces experienced by the drill string without considering the interaction of the drill bit with the rock.

A large portion of the early work in relation to drilling wells and the effect various forces and assemblies have during that process were carried out in the 1950's by Lubinski, A. and Woods, H. B. The models suggested by these early innovators were quite simple. However, as the requirement for more complicated wells has increased these earlier works have been improved upon and further parameters are now taken into consideration. Once the importance of a previously unknown parameter (or a previously considered unimportant parameter) is identified it is very easy to realise the effect that parameter has on the well trajectory simply by not accounting for it in the modeling process.

A current model used in relation to predicting well trajectories is described in the publications "Prediction of Drilling Trajectory in Directional Wells Via a New Rock-Bit Interaction Model", SPE Ann. Conf., Paper #16658, 1987 and in "General Formulation of Drill string Under Large Deformation and its Use in BHA Analysis", SPE Annual Technical Conf. and Exh., October 1986, both by Hwa-Shan Ho. These publications go some way of taking into consideration the interaction between the bit and the rock, as well as side forces generated by the BHA.

This model was further described in U.S. Pat. No. 4,804,051, to Hwa-Shan Ho. This patent describes a model which accounts for a parameter(s) relating to the interaction of the bit and the rock, particularly taking into account/predicting the walk tendency of a given BHA. This model introduces the "anisotropy index," which is the ratio between lateral drillability to axial drillability, and the walk angle—the angle between the lateral force and the lateral displacement.

Theoretical methods to compute the bit anisotropy index (renamed bit steerability) and the walk angle from simple bit geometrical parameters have been disclosed in two publications: S. Menand, H. Sellami, C. Simon, A. Besson and N. Da Silva, "How the bit profile and gages affect the well trajectory", in *Proceedings of IADC/SPE Drilling Conference* held in Dallas, February 2002, IADC/SPE 74459; and S. Menand, H. Sellami and C. Simon, "Classification of PDC bits steerability according to their steerability", in *Proceedings of IADC/SPE Drilling Conference* held in Amsterdam, February 2003. IADC/SPE 79795. In these publications, the curvature of the bore is considered to be inversely proportional to an arbitrary length, which in practice is chosen to be about 10 meters.

Finally, the above models from Ho and Menand et al. take into account the effect of rock anisotropy only through its effects on the side force on the bit.

The preceding discussion of the background to the invention is intended only to facilitate an understanding of the present invention. It should be appreciated that the discussion is not an acknowledgement or admission that any of the material referred to was part of the common general knowledge as at the priority date of the application.

SUMMARY OF INVENTION

It is an object of this invention to provide means to more accurately predict well trajectory.

The present invention relies on a model, which takes into account additional quantities over those considered in the prior art; these quantities relate to the interaction between the bit and the rock formation.

The invention deals with the characterization of a bit within the framework of a model of the borehole evolution. This characterization is embodied in a set of parameters that quantifies the contribution of the bit within the context of this model. Furthermore, the relationship between the bit design and this set of parameters (dubbed the bitmetrics) can be established through either computational or experimental means.

The present invention provides a method of predicting a well trajectory wherein the method utilises a model into which a series of parameters are used to calculate the trajectory characterised in that the parameters take into account the angle of the drill bit relative to the well bore, as well as the variation of this angle during drilling. The variation of this angle is related to the moment on the bit.

The present invention deals specifically with the characterization of the bit in the interaction laws that link the bit penetration variables to the forces on the bit. This characterization takes the form of a set of lump parameters that are related to the particulars of a bit design. These parameters are uniquely related to a bit design; however, some of these parameters are affected by the bit wear. The definition of these lump parameters must be compatible with the mechanical description of the drill string, which is typically modeled within the framework of beam theory. Moreover, the linkage between the lumped parameters and the bit design involves only consideration at the bit scale, which is of order of the bit radius (a); this linkage is independent of the solution of any particular initial/boundary value problems.

The present invention provides a method to characterize a drill bit for directional drilling so as to provide the bit with a set of lump parameters, the lump parameters enabling one to identify the relationship between the angular, axial and lateral penetration of the bit and the forces and moment on the bit when cutting into a particular rock formation. The lump parameters may be used to identify the required drill bit design when directional drilling. This may include identifying the required drill bit design when directional drilling with a particular rotary steerable system.

Once the cutting characteristics of a drill bit are known, via the set of lumped parameters, it is possible to use this to better predict the expected trajectory of the well using that particular bit. This will allow operators to increase the distance/time between subsequent reviews of the drilling direction as it enables greater predictability. The information can also be used to:

a. design bits such that those key features which dictate the behavior of the drill bit are optimized for particular drilling conditions;
b. improve design of steerable robots, both the actual robot and the software which controls the robot, so that the robot constantly diagnoses the drilling direction and where correction is required, applies the required correction according to the bit.
c. identify whether the bit is performing as expected and whether it needs replacing.
d. monitor the change in the bit characteristics (via change in the lumped parameters) as the bit is undergoing wear.

The present invention provides a method of determining a set of lump parameters of a given bit design, the method comprises:

placing the bit on a test rig, allowing bit to engage a rock formation of known properties whereby the bit rotates relative to the rock;

applying a kinematically controlled motion to the bit that results in a combination of axial ($d_1$), lateral ($d_2$), and angular penetration ($\phi$) per revolution of the bit into the rock;

measuring the resultant forces $\hat{F}_1$ and $\hat{F}_2$i, where $\hat{F}_1$ is the axial force on the bit—commonly referred to as the weight-on-bit—, and $\hat{F}_2$ is the lateral force on the bit;

performing best fit of data and obtain values of the coefficients G's and H's from best fit wherein:

$$\hat{F}_1=H_1^I d_1 \text{ if } \hat{F}_1 \text{ is proportional to } d_1$$

or $$\hat{F}_1=G_1^{II}+H_1^{II}d_1 \text{ if } \hat{F}_1>G_1^{II}$$

and $$\hat{F}_2=H_2 d_2$$

extracting the properties of the rock (intrinsic specific energy $\epsilon$, and the contact strength $\sigma$) from consideration to determine values for lump parameters $A_1$, $A_2$, $A_3$, and $B_1$ independent of the rock, whereby $$G_1^{II}=B_1\sigma$$

$$H_1^I=A_1\epsilon,\ H_1^{II}=A_2\epsilon,\ H_2=A_3\epsilon;$$

measuring the resulting moment on the bit $\hat{M}$ performing best fit of data to determine values of $H_o$, given that $$\hat{M}=H_0\phi,$$

extracting the properties of the rock from consideration to determine lump Parameters $C_1$, $$H_0=C_1\epsilon,;$$

so as to provide a set of five lump parameters $$B=\{A_1,A_2,A_3,B_1,C_1\}$$

for that given bit.

The method may further comprise the step of determining the expected trajectory of the well when drilling with a drill bit having the set of lump parameters B.

The present invention further provides a test rig for exerting motion and measuring the resultant forces and moments placed upon a drill bit cutting into a specimen.

The test rig may be capable of applying an axial velocity relative to the bit, or an axial velocity in combination with a lateral velocity and/or an angular velocity relative to the bit.

The test rig may be capable of measuring the forces resulting from the application of motion relative to the bit.

Preferably the properties of the rock specimen into which the bit cuts are known.

The test rig may be adapted such that the specimen moves relative to the bit.

The test rig may be adapted so that the specimen rotates whilst the axial, lateral and/or angular velocity is applied to the bit.

In another aspect of the apparatus the specimen may move horizontally in two orthogonal directions while the drilling rod is restricted to move in the vertical direction only.

The present invention provides a link, using either experimental or computational means, between the detailed bit design and the bitmetrics (B) coefficients—the lump parameters—that allows one to compute the average bit response when the bit/rock interaction is characterized by axial and lateral penetration of the bit and relative change of orientation of the bit with respect to the borehole axis.

The present invention also provides methodologies to assess the bitmetric (B) coefficients for a given bit, or for a bit in which the detailed geometry is provided (shape of the cutting edge, position of the cutters on the bit body, length of the gauge). The method may include computational means.

The present invention provides a method to calculate the effect of the formation anisotropy on the bit trajectory. The formation anisotropy is associated to a force imbalance on the cutters on the bit, which after averaging over one revolution alters the relationship between the moment on the bit and the angular penetration. The method comprises:

assessing the variation of the specific energy $\epsilon$ and of the contact strength $\sigma$ with the direction of motion of the cutter relative to the axis of transverse isotropy of the rock, using experimental or computational means;

computing the forces on each cutter of the bit and averaging the forces over one revolution of the bit;

computing the residual moment on the bit, $\hat{M}_r$, from the average cutter forces (this residual moment on the bit is not related to the angular penetration of the bit; $\hat{M}_r$ is generally non-zero if the bit axis is inclined on the axis of transverse symmetry of the rock);

subtracting $\hat{M}_r$ from the moment on the bit $\hat{M}$ to compute the effective moment $\hat{M}_e=\hat{M}-\hat{M}_r$;

using $\hat{M}_e$ instead of $\hat{M}$ in the bit-rock interaction laws to determine the behavior of the bit through an isotropic formation.

The present invention provides a method to calculate the effect of a layered formation on the bit trajectory, when the layer thickness are comparable to the bit radius. The layered formation is associated to a force imbalance on the cutters on the bit, which after averaging over one revolution alters the relationship between the moment on the bit and the angular penetration. The method comprises:

using experimental or computational means, assessing the specific energy $\epsilon$ and of the contact strength $\sigma$ within each of the layers which are simultaneously drilled by the bit, when the axis of the bit is inclined on the normal to the planes of stratification;

computing the forces on each cutter of the bit and averaging the forces over one revolution of the bit computing the residual moment on the bit, $\hat{M}_r$, from the average cutter forces (this residual moment on the bit is not related to the angular penetration of the bit; $\hat{M}_r$ is generally non-zero if the bit axis is inclined on the axis of transverse symmetry of the rock);

subtract $\hat{M}_r$ from the moment on the bit $\hat{M}$ to compute the effective moment $\hat{M}_e=\hat{M}-\hat{M}_r$;

using $\hat{M}_e$ instead of $\hat{M}$ in the bit-rock interaction laws to determine the behavior of the bit through the layered formation.

The present invention provides a means to compute the borehole curvature from the angular penetration, the axial penetration, and the lateral penetration.

The present invention provides a method for characterizing a drill bit, the method comprises:

imposing a combination of motions on the bit;

determining the force(s) and moment(s) acting on the bit;

computing a set of lump parameters wherein the parameters characterize the bit.

The method as described above wherein the force and moments result from the imposed motion.

The step of imposing the combination of motions may comprise imposing an axial velocity relative to the bit, or an axial velocity in combination with a lateral velocity and/or an angular velocity relative to the bit.

The step of determining the force(s) and moment(s) may comprise determining the axial force, lateral force and moments acting on the bit.

The step of determining the moment(s) acting on the bit may comprise determining the moment(s) on the bit generated as a result of the bits orientation relative to the borehole.

The method may be executed on a test rig capable of applying motions and measuring the generated force(s) and moment(s).

The present invention provides a method for characterizing a drill bit, the method comprises:

determining the force(s) and moment(s) acting on the bit;

computing a set of lump parameters wherein the parameters characterize the bit.

The present invention provides a method for characterizing a drill bit having a plurality of cutters, the method comprises:

analyzing and determining the characteristics of each cutter;

summating the characteristics of each cutter and accounting for the geometrical layout of the cutter on the bit face as well as the geometry of a gauge pad on the bit to provide the set of lump parameters for the bit to enable the bit to be characterized.

A method of predicting the borehole trajectory which considers the moment(s) and force(s) acting on the bit wherein those moment(s) and force(s) are governed by the borehole geometry and the drill string geometry.

By taking into consideration the moments acting on a bit, it is no longer necessary to use an ad hoc/arbitrary length scale in order to predict the borehole curvature, as per the prior art. Similarly, when drilling through an anisotropy formation or layered formation, the effect of drilling through material having different properties does not require the inclusion of ad hoc coefficients in the bit-rock interaction law if the moments acting on the bit are considered.

Furthermore, a distinction is drawn between the contact and the penetration mode of interaction between the bit and the rock.

The introduction of $\hat{M}$ (moment) and $\phi$ (angular penetration) is essential as it enables one to relate naturally the curvature of the borehole to the penetration variables. In other words, the radius of curvature of the borehole is proportional to a length scale equal to the ratio of the moment on the bit over the weight on bit (or to a generalization of this ratio). In the prior art models, the radius of curvature is proportional to an ad hoc length scale, typically about 10 m, but that can be adjusted to fit field data.

The present invention provides a means to characterize a bit. Once the behavior of the bit relative to a rock formation is known, then this information can be used throughout various aspects of well drilling to provide a more accurate means to predict and control well trajectory. A unique feature of the present invention is the identification of the importance of the moments acting on the bit and the way in which this discovery is used to more accurate predict the well trajectory during directional drilling of a well.

DESCRIPTION OF THE DRAWINGS

The invention will be better understood by reference to the following description of several embodiments thereof as shown in the accompanying drawings in which.

BEST MODE(S) FOR CARRYING OUT THE INVENTION

Figure 1:
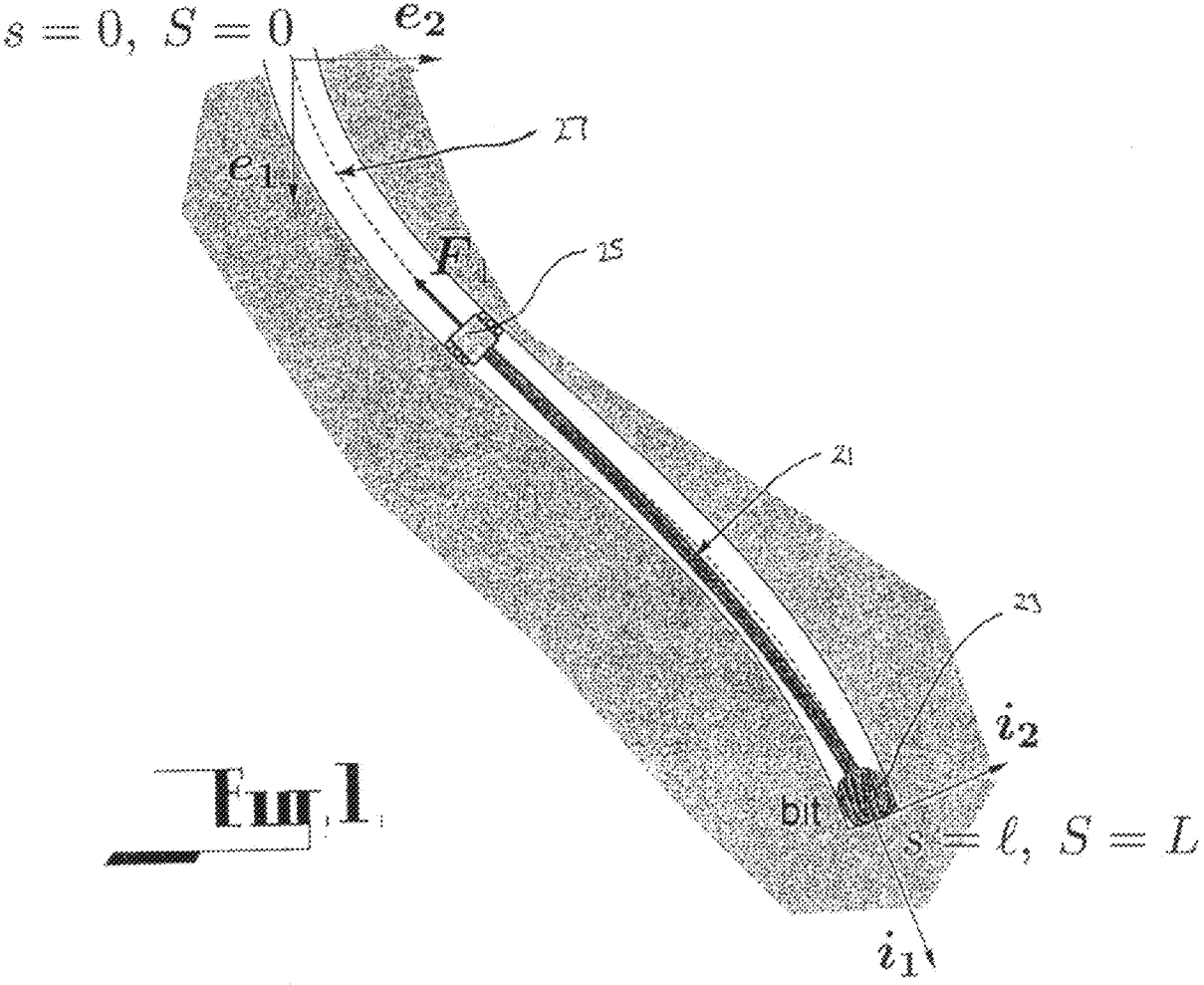
FIG. 1 is a schematic view of a bottom hole assembly (BHA) in a well.

FIG. 1 shows the segment of a bottom hole assembly (BHA) 21 between a bit 23 and a first stabilizer 25 located above the bit 23. Propagation of a borehole 27, but also the penetration rate and the direction of advance of the bit 23, can in principle be determined from the illustrated borehole geometry, knowing the configuration of the BHA 21, the axial force $\overline{F}_1$ acting on the stabilizer, and any other forces acting on the BHA 21 (such as gravity and the forces introduced by rotary steerable systems).

Note that only the axial force $\overline{F}_1$ is needed (and not the transverse force $\overline{F}_3$ or the moment $\overline{M}$) if the movement of the stabilizer is restricted to sliding along the borehole. In the complete version of this problem, description of the drill string would not be limited at the first stabilizer, but would include the complete description from the bit to the rig, as well as the complete geometry of the borehole. It would also allow one to consider non-ideal stabilizers, which can tilt and move sideways relative to the borehole axis. However, an intermediate description that includes the first few stabilizers above the bit is likely to be sufficient to predict the borehole evolution.

Detailed below is a model for directional drilling. For the purpose of introducing the set of coefficients that are defined through the boundary conditions at a bit-rock interface (the bitmetrics), it is sufficient to deal with plane borehole trajectories. As all quantities (such as forces, velocities) used in the model are averaged over at least one revolution of the bit, there is complete symmetry of revolution in the bit-rock interaction model and therefore the same set of bit-rock interaction parameters is involved in the modeling of either planar or non-planar borehole geometries.

In providing the model for directional drilling, there are three model components which need to be first considered:

(i) a geometrical model dealing with the evolution of the borehole, (ii) a bit-rock interaction model establishing the relationship between the bit-rock penetration variables linked to the borehole geometry and the forces on the bit, and (iii) a mechanical model dealing with the elastic response of the drill string under loads and constrained to deform within the borehole.

(i) Geometrical Borehole Model

Figure 2:
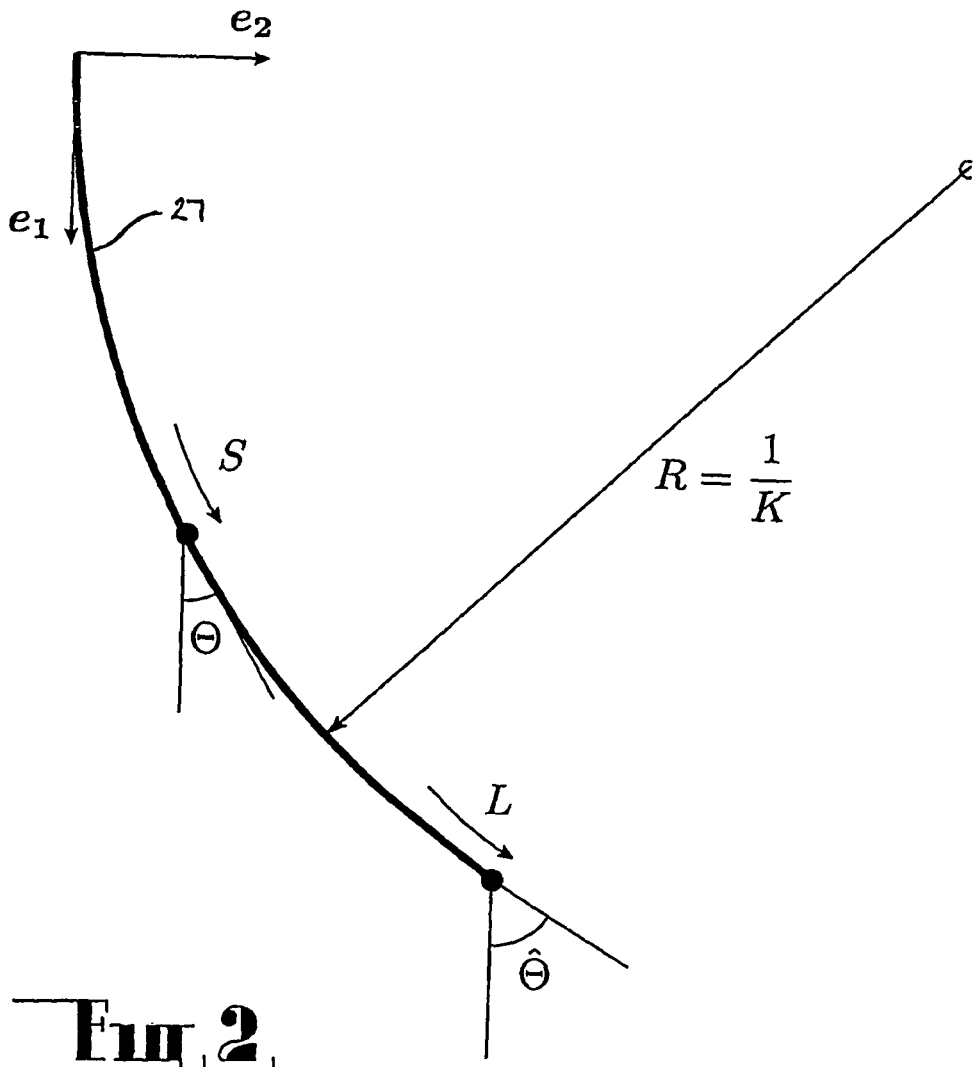
FIG. 2 is a schematic view of the geometry of a bore hole.

Referring to FIG. 2, $e_1$ and $e_2$ denote the axes of a fixed system of coordinates, L denotes the current length of the borehole and S the curvilinear coordinate that defines a point on the borehole curve. Thus $0 \le S \le L$, with S=0 corresponding to the borehole entry on the earth surface and S=L to the current bottom of the borehole.

At length scale L, the borehole is a 1D object, and thus its geometry can be completely defined by the inclination angle $\Theta(S)$ for planar trajectories, see FIG. 2. However, function $\Theta(S)$ is not sufficient to describe the borehole geometry when it is viewed at length scale a, the bit radius. Indeed, the main borehole feature affecting the interaction between the bit and the rock, beside the local inclination $\hat{\Theta}=\Theta(L)$ (wherein "^" denotes the hole bottom), is the clearance between the bit and the borehole, as it constrains the tilt of the bit. Thus to describe the borehole geometry at the length scale a, the overgauge factor $\Xi(S)$ is introduced, where $$\Xi = \frac{A}{a} - 1$$

with A(S) denoting the mean borehole radius at position S. Although $\Xi(S) \ge 0$ by definition, the overgauge factor cannot be smaller than $\Xi_o \ll 1$, for a variety of technological and practical reasons. Furthermore, the overgauge factor is small under normal drilling condition.

The borehole needs to be characterized at both length scales L (length of borehole) and a (bit radius) for the purpose of directional drilling. Actually, it is appropriate to characterize the borehole as a "1D+$\epsilon$" object, since $\epsilon = a/L \ll 1$. Accordingly, the borehole is described by two functions, the inclination angle $\Theta(S)$ and the overgauge factor $\Xi(S)$.

It is also useful to introduce the borehole curvature K(S), which is related to Θ(s) according to $$K = \frac{d\Theta}{dS}$$

As the borehole length is evolving, $\hat{K}$ is actually a function of L, but the function $\hat{K}(L)$ is identical to the function K(S). Similar comments apply to the functions Θ(S), $\hat{\Theta}(L)$ and Ξ(S), $\hat{\Xi}(L)$.

Formulation of the borehole propagation problem requires therefore to prescribe the equations governing the evolution of both Θ and Ξ. In other words, assuming that the length of the borehole has reached L and thus that the geometry of the hole is known in the interval 0<S<L, through the inclination Θ(S) and the overgauge factor Ξ(S), the equations that will enable one to evolve the borehole geometry from L to L+ΔL must be derived.

The propagation of the borehole requires to specify a certain derivative of Θ(S) and of Ξ(S) at S=L; The question is to understand to which order the derivatives have to be specified, and how these derivatives are linked to the bit boundary conditions. Before answering these questions, it is useful to tabulate the different types of borehole trajectories that can take place, see Table 1 below.

TABLE 1

Types of borehole trajectories - Note that [f] denotes a discontinuity (jump) in f

| Type | Characteristics | Continuity of Θ(S) | Nature of Problem |
|---|---|---|---|
| $T_1$ | $K = K_o$ along curve | $C_\infty$ | Stationary solution |
| $T_2$ | [K'] ≠ 0 at discrete points | $C_1$ minimum | Evolution problem |
| $T_3$ | [K] ≠ 0 at discrete points | $C_0$ | Evolution problem |
| $T_4$ | [Θ] ≠ 0 at discrete points | Piecewise continuous | Evolution problem |

Consider first the curve $T_1$ corresponding to a circular arc (which can degenerate into a linear segment). Borehole segment belonging to the $T_1$ type represents stationary solutions. Borehole trajectories of the type $T_2$-$T_4$ have a varying curvature, which require solving an evolution problem. These curves differ by the degree of continuity, which depends on the nature of the bit boundary conditions, as discussed below. For example, $T_3$ could be characterized by a jump in the curvature, at some discrete points along the curve; $T_4$ includes borehole with doglegs. Evidently, the overgauge factor is controlled by the tilt of the bit with respect to the borehole axis under normal drilling conditions. (Note that the overgauge factor could also be affected by whirling of the bit.)

Due to the nature of the boundary conditions at the bit-rock interface the borehole evolution problem can be mathematically formulated as:

$$\frac{d^2\Theta}{dS^2} = F(S),\ \frac{d\Xi}{dS} = G(S) \tag{1.0}$$

given the initial conditions at $S=S_o$ $$\Theta, K, \Xi \text{ at } S=S_o \tag{1.1}$$

where the functions F(S) and G(S) are determined through the other components of the model, and where the initial position could be interpreted as the current length L.

As discussed above, different orders of continuity could exist in the functions Θ(S) and Ξ(S). The discontinuities that have been identified in Table 1 are nonetheless compatible with the evolution equations but they require additional information on the jump of the quantities.

Also, the δ operator is introduced to denote the variation of a quantity over one revolution of the bit. In particular, $\delta\hat{\theta}$ represents the variation of the absolute bit inclination and δL the increment of the borehole length after one bit revolution. In fact, these two variations can be related to the penetration of the bit as $$\delta\hat{\theta}=\phi,\ \delta L=d \tag{2.0}$$

where d is the magnitude of the penetration vector d.

Bit Penetration Variables and Bit Tilt

The incremental propagation of the borehole when described by the penetration of the bit in the rock as bit penetration over one revolution implies removal of rock. Bit penetration over one revolution is in fact associated with a translation corresponding to a penetration vector d and with a rotation. For plane trajectories, three "penetration variables" need to be introduced to describe the cutting of the rock by the bit over one revolution, namely, two components of the penetration vector, and a rotation. The penetration variables are naturally expressed in the director basis associated with the bit. Let the axis $\hat{i}_1$ of the director basis coincide with the bit axis of symmetry while pointing ahead of the bit and let the axis $\hat{i}_2$ point 90° counterclockwise from $\hat{i}_1$, as shown in see FIG. 3(*a*).

The three quantities that describe the penetration of the bit per revolution are:

(i) the axial penetration $d_1$, (ii) the lateral penetration $d_2$, and (iii) the angular penetration ϕ.

As depicted in FIGS. 3*b*, 3*c*, 3*d* respectively.

The inclination β of the penetration vector d on the axis of revolution of the bit is given by $$\beta = \arctan\frac{d_2}{d_1}$$

Figure 3:
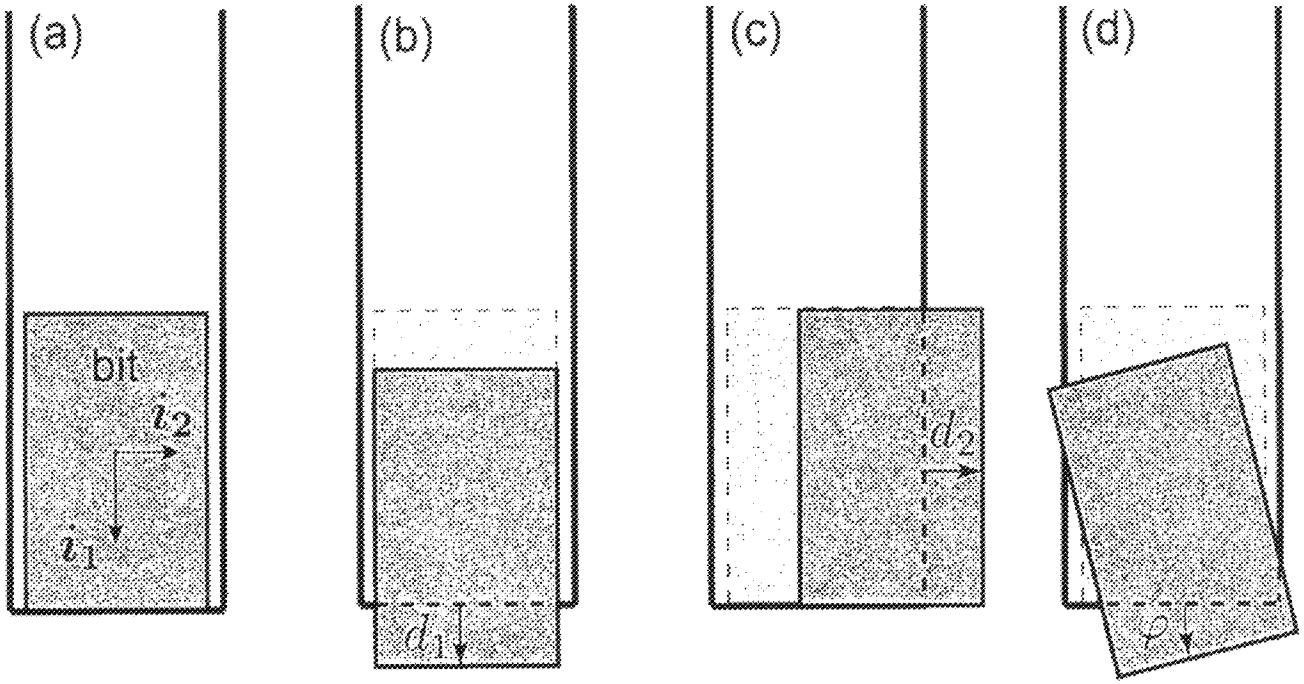
FIGS. 3*a*, 3*b*, 3*c*, 3*d* is a schematic view of a drill bit according to degrees of freedom.

FIG. 3 illustrates the three modes of penetration of the bit into rock (axial and angular penetration are combined, however, for physical consistency in FIG. 3(*d*)).

The above penetration quantities represent the fundamental state variables for the interface laws between the bit and the rock.

Figure 4:
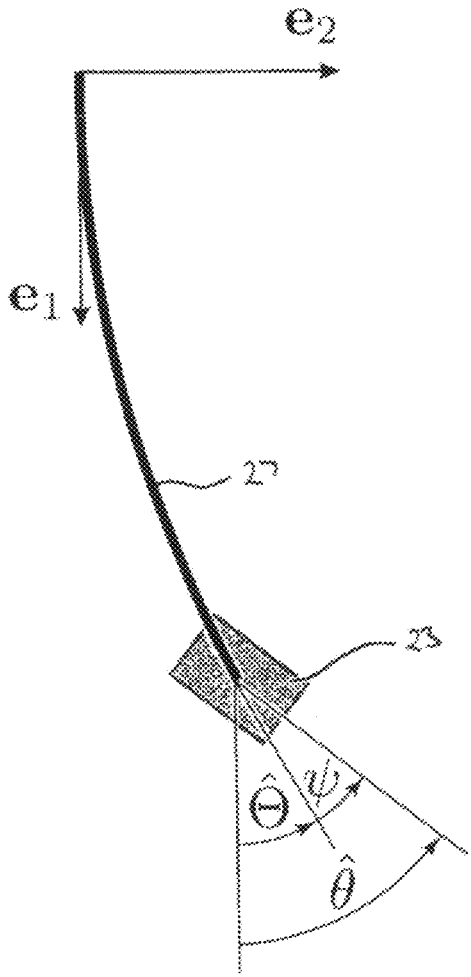
FIG. 4 is a schematic view of the angular geometry of a bit relative to the bore hole.

The tilt ψ of the bit relative to the borehole is defined as $$\psi=\hat{\theta}-\hat{\Theta}$$

where $\hat{\theta}=\theta(l)$ denotes the inclination of the bit and $\hat{\Theta}=\Theta(L)$ the borehole inclination at the bottom, see FIG. 4 illustrating the various angles $\hat{\theta}$, $\hat{\Theta}$, and ψ.

Figure 5:
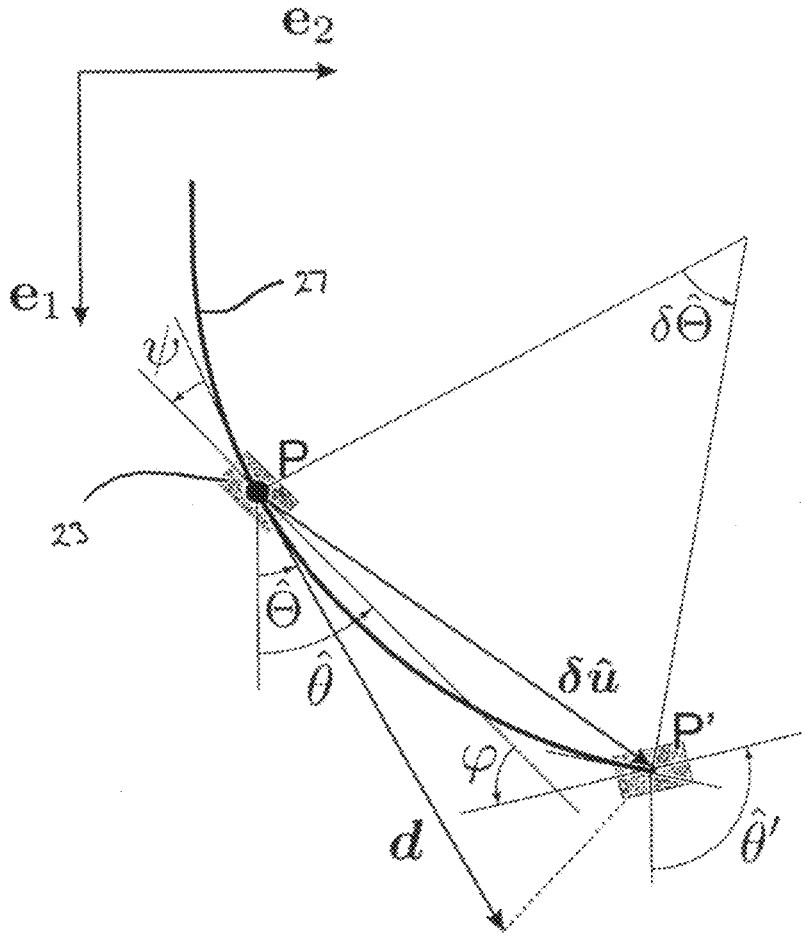
FIG. 5 is a schematic view showing the difference between incremental displacement vector $\delta\hat{u}$ of the bit over one revolution and penetration vector d for a curved bit trajectory.

The incremental displacement vector $\delta\hat{u}$ and incremental rotation $\phi=\delta\hat{\theta}$ of the bit over one revolution is introduced. The components of $\delta\hat{u}$ in the bit director basis are $\delta\hat{u}_1$ (the incremental axial displacement), and $\delta\hat{u}_2$ (the incremental transverse displacement) see FIG. 5. It should be noted that the penetration variables are not necessarily equal to the bit incremental displacement and rotation, as discussed below. (To our knowledge, confusion between the two quantities $\delta\hat{u}$ and d is implicit in all the published work on directional drilling.)

Relationships Between Geometrical Features of the Borehole and Bit Penetration

It is now required to establish how the inclination $\hat{\Theta}$, the curvature $\hat{K}$, and over-gauge factor of $\hat{\Xi}$ the borehole at S=L are related to the penetration variables $d_1$, $d_2$, and $\phi$, as well as to the inclination $\hat{\theta}$ and tilt $\psi$ of the bit. These relationships are critical for the establishment of the link between the geometrical problem of the borehole evolution and the mechanical problem of the drill string.

1. Borehole Inclination $\hat{\Theta}$

Figure 6:
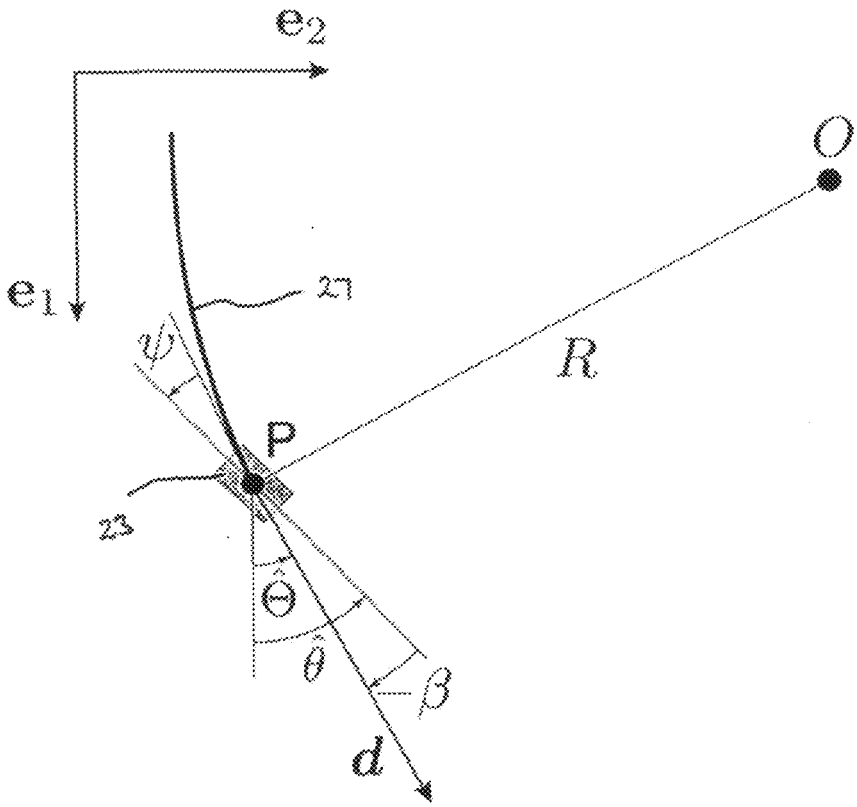
FIG. 6 is a schematic view showing the relationship between the bit tilt $\psi$ and the angle $\beta$.

Referring to FIG. 6 as the penetration vector d is tangent to the borehole axis, the bit tilt $\psi$ is related to the inclination $\beta$ of d on the axis of revolution of the bit according to $$\psi + \beta = 0 \tag{2.1}$$

where $$\beta = \arctan\left(\frac{d_2}{d_1}\right) \tag{2.2}$$

Hence, $$\hat{\Theta} = \hat{\theta} + \beta \tag{2.3}$$

in view of the definition of the bit tilt.

As it will be made clear later, the above geometrical condition imposes a constraint on the moment and forces on the bit, via the interface laws and the equations governing the deformation of the BHA. Notwithstanding the relation (2.1) between the bit tilt and the inclination of the penetration vector, a distinction between the two angles $\psi$ and $\beta$ is maintained to emphasize that the kinematical constraint (2.1) arises only during drilling.

The above relations (2.1)-(2.3) are also valid for cases where some of these angles are discontinuous, provided that they are applied on the same side of the discontinuity; e.g., $\hat{\Theta}^+=\hat{\theta}^++\beta^+$. However, not all the angles have to be discontinuous; e.g., $[\hat{\Theta}]=[\beta]\neq 0$, but $[\hat{\theta}]=0$.

2. Borehole Curvature $\hat{K}$

The curvature of the borehole at S=L, when the bit is drilling, can be expressed in terms of the $\delta$-variation of $\hat{\Theta}$ and the penetration d according to $$\hat{K} = \frac{\delta\hat{\Theta}}{d} \tag{2.4}$$

Using (2.0) and (2.3), $\hat{K}$ can be rewritten as $$\hat{K} = \frac{\varphi + \delta\beta}{d} \tag{2.5}$$

The angular penetration $\phi$ of the bit reflects not only a rigid body rotation of the BHA associated with its motion inside the curved borehole, but also a change in the deformed configuration of the BHA caused by change in the loading, e.g., change in the forces applied by a RSS (rotary steerable system)). Incidentally, any variation in the loading of the BHA also causes a change in the direction of the penetration vector. These remarks indicate that continuous changes in the loading of the BHA will result in a variation of the borehole curvature. Hence:

$$\frac{d\hat{K}}{dL} = \frac{\delta\varphi + \delta^2\beta}{d^2} - \frac{\delta d(\varphi + \delta\beta)}{d^3} \tag{2.6}$$

The right-hand side of (2.5) and (2.6) can eventually be expressed in terms of the mechanical problem, through consideration of the bit-rock interface laws and of the mechanics of the drill string.

3. Borehole Overgauge $\hat{\Xi}$

Figure 7:
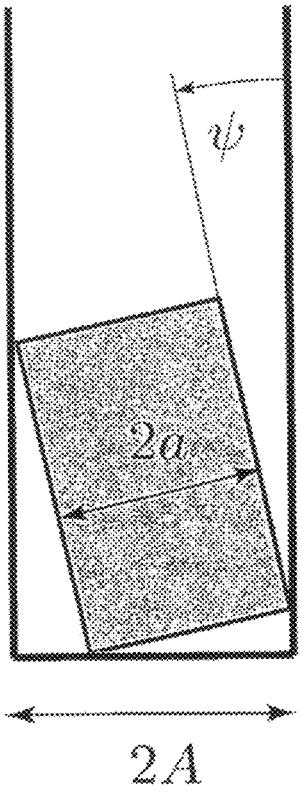
FIG. 7 is a schematic view of the relationship between borehole diameter, bit tilt, and bit slenderness.

During drilling, the tilt of the bit is directly related to the overgauge factor $\hat{\Xi}$. Using simple geometrical considerations, it can readily be derived that (see FIG. 7)

$$\hat{\Xi} = \Xi_o + \frac{2}{\pi}\nu|\psi| \tag{2.7}$$

where v is the slenderness of the bit (that would be equal to the height to diameter ratio if the bit was a simple cylindrical object). Thus the evolution equation for $\hat{\Xi}$ is given by $$\frac{d\hat{\Xi}}{dL} = \frac{\nu\mathrm{Sign}(\beta)\delta\beta}{d} \tag{2.8}$$

where the kinematical constraint (2.1) is taken into account.

The above equations (2.6) and (2.8) can be translated as evolution equations for $\hat{K}$ and $\hat{\Xi}$, i.e., $$\frac{d\hat{K}}{dL} = F(L),\ \frac{d\hat{\Xi}}{dL} = G(L) \tag{4}$$

where the explicit forms of the functions F(L) and G(L) can be obtained in terms of the penetration variables.

(ii) Bit-Rock Interaction Model

Cutter-Rock Interaction

As an introduction to the formulation of the bit-rock interface laws, the force acting on a rectangular cutter of width w is first considered. This force steadily removes rock over a constant depth d, as sketched in FIG. 8*a*. The action of such a tool generally consists of two independent processes: (i) a pure cutting process taking place ahead of the cutting face, and (ii) a frictional contact process mobilized along the interface between the wearflat and the rock. The force F on the cutter results therefore from the superposition of two forces $F_c$ and $F_f$, acting on the cutting face and on the wearflat, respectively. In the following, the relationship between $F_n$, the component of F perpendicular to the cutter motion, and the depth of cut d is the primary focus. It is assumed that $F_n$ is averaged over a distance equal to at least a few times the depth of cut, to ensure that the mean force $F_n$ does not depend on the cut length under homogeneous conditions.)

Figure 8:
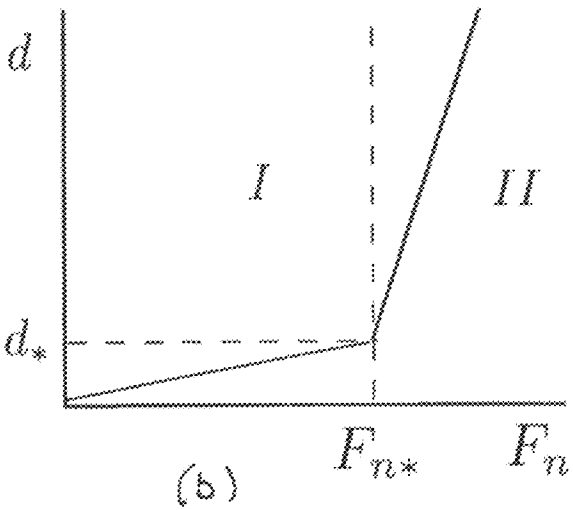
FIG. 8 is a schematic view of the forces on a cutter (a) and on two regimes I and II (b)
Figure 8:
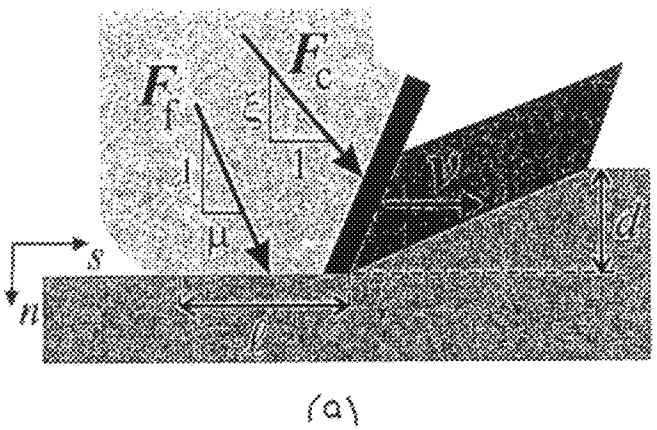

Single cutter experiments in the ductile mode (i.e., without chipping) indicate that the relationship between $F_n$ and d is bilinear, see FIG. 8*b*. Two regimes can thus be identified, which will be denoted as I and II.

Regime I ($F_n<F_n^*$)

This regime is characterized by a progressive increase of the contact forces with d. It is conjectured that this increase of the contact force is predominantly due to a geometrical effect, as the two contacting surfaces are generally not conforming. Change in the depth of cut d indeed affects the angle between the two contacting surfaces thus causing a variation of the actual contact area (the inclination of the rock surface in the tangential direction is parallel to the cutter velocity whose vertical component is proportional to d).

The response equations for phase I are derived on the assumption that both the contact and the cutting component of $F_n$, i.e., $F_{nf}$ and $F_{nc}$, increases linearly with the depth of cut d $$F_{nf}=\tilde{n}\sigma wd,\ F_{nc}=\zeta\epsilon wd \tag{3.1}$$

In the above, $\epsilon$ is the intrinsic specific energy, the energy required to remove a unit volume of rock in the absence of frictional contact (i.e., the energy expended in the absence of any wearflats), $\zeta$ is a number of order O(0.1~1) that reflects the inclination of the cutting force, and $\sigma$ is the contact strength, the maximum contact pressure that can be transmitted at the wearflat/rock interface. Unlike the intrinsic specific energy $\epsilon$ that is associated with uncontained flow of failed particles ahead of the cutter, the contact strength $\sigma$ reflects the existence of a contained plastic flow process underneath the cutter wearflat, and thus will generally depend on the elastic modulus and strength parameters of the rock.

Depending on rock and the pressure environment, both $\epsilon$ and $\sigma$ can vary from a few MPa to several hundred MPa (up to the GPa range). In cutting tests performed at atmospheric pressure, $\sigma$ and $\epsilon$ are observed to be of the same order. This may vary when cutting under downhole conditions. Note that $\epsilon$ is about equal to the unconfined (uniaxial) compressive of the rock being cut under atmospheric conditions. If the increase of $F_{nf}$ with d is entirely due to a geometrical effect, then $\tilde{n}$ represents the rate of change of the contact length with d.

Combining the above relations (3.1) for $F_{nf}$ and $F_{nc}$ yields the following relationship between $F_n$ and d $$F_n=(\zeta\epsilon+\tilde{n}\sigma)d,\ F_n\leq F_n^* \tag{3.2}$$

which is rewritten as $$F_n=\zeta'\epsilon wd \tag{3.3}$$

where $$\zeta'=\xi\zeta \tag{3.4}$$

with the number $\xi$ defined as $$\xi=\left(1+\tilde{n}\frac{\sigma}{\varepsilon}\right)\cong\zeta\tilde{n}\frac{\sigma}{\varepsilon} \tag{3.5}$$

The number $\zeta'$ is expected to be of order O(10~100), and thus $\xi$ is likely to be of order O(10). The threshold normal force $F_n^*$ is given by $$F_{n^*}=\left(1+\frac{\zeta\varepsilon}{\tilde{n}\sigma}\right)\sigma wl \tag{3.6}$$

where l is the length of the wearflat, see FIG. 8*a*.

Regime II ($F_n>F_n^*$)

In Regime II, the contact forces are fully mobilized. In other words, the contact forces do not increase anymore because the normal contact stress has reached a maximum value $\sigma$, and the actual contact length has attained a limiting value that characterizes the present degree of bluntness of the bit. This cutting regime is thus defined by $F_{nf}=\sigma wl$, with the consequence that any increase of the normal force $F_n$ beyond $F_n^*$ must necessarily be translated as an equal increase of the force $F_{nc}$ on the cutting face. In Regime II, the bit behaves incrementally as an ideally sharp bit. This regime is thus characterized by proportionality between ($F_n-F_n^*$) and ($d-d^*$)

$$F_n=F_n^*+\zeta\epsilon w(d-d^*) \tag{3.7}$$

where the critical value of the depth of cut per revolution $d^*$ (function of the bit bluntness) is given by $$d^*=l/\tilde{n} \tag{3.8}$$

The response (3.7) for Regime II can be rewritten as $$F_n=\sigma wl+\zeta\epsilon wd,\ F_n\geq F_n^* \tag{3.9}$$

or for all practical purposes as $$F_n=F_n^*+\zeta\epsilon wd,\ F_n\geq F_n^*=\sigma wl \tag{3.10}$$

In fact, $\sigma wl$ represents the threshold normal force that can be transmitted by the wearflat.

Bit-Rock Interface Laws

Considering plane trajectories, the bit boundary conditions are naturally expressed in the director basis ($\hat{i}_1$, $\hat{i}_2$) associated with the bit. Let $\hat{F}$ denote the force on the bit and d the penetration per revolution. The components $\hat{F}_i$ and $d_i$ are defined in the director basis, i.e.

$$\hat{F}_i=\hat{F}\cdot\hat{i}_i\ d_i=d\cdot\hat{i}_i$$

Also, moment $\hat{M}$ with axis corresponding to $\hat{i}_3$, which is perpendicular to the plane ($\hat{i}_1$, $\hat{i}_2$) is introduced. The generalized forces $F=\{\hat{F}_1,\hat{F}_2,\hat{M}\}$ are conjugated to the generalized velocities (defined per revolution) $V=\{d_1,d_2,\phi\}$ in the sense that the bit-rock interface law is simply the relationship between the force F and the velocity V.

Adopting a linear form for this relationship, i.e., $$\begin{Bmatrix}\hat{F}_1\\ \hat{F}_2\\ \hat{M}\end{Bmatrix}=-\begin{Bmatrix}G_1\\ G_2\\ G_0\end{Bmatrix}-\begin{bmatrix}H_1 & 0 & 0\\ 0 & H_2 & 0\\ 0 & 0 & H_0\end{bmatrix}\begin{Bmatrix}d_1\\ d_2\\ \varphi\end{Bmatrix}$$

The matrix H is thus diagonal for an isotropic rock. It can in fact be assumed that the coefficients $G_0$ and $G_2$ are equal to zero. Indeed, the lateral and angular penetrations are expected to be both dominated by the contact process (Regime I), in contrast to the axial bit-rock interaction, which should ideally be in Regime II (i.e., with W larger than the threshold force $G_1^{II}=W^*$).

In summary, the bit-rock interaction for plane borehole trajectories can be written $$\hat{F}_1=-G_1-H_1d_1,\ \hat{F}_2=-\eta H_1^{II}d_2,\ \hat{M}=-h^2H_1^{II}\varphi \tag{4.0}$$

where two quantities that reflect the geometry of the bit are introduced, the number $\eta$ and the length h $$\eta=\frac{H_2}{H_1^{II}},\quad h=\sqrt{\frac{H_0}{H_1^{II}}}$$

and where $H_1^{II}$ denotes the coefficient $H_1$ in Regime II. Assuming a simple cylindrical geometry for the bit (i.e., diameter 2a and length 2b), it can readily be shown, using information from single cutter experiments, that $\eta$ is of order O(10) and that h/a is of order $O(\eta^{1/2}v)$. Indeed, $$\eta=\frac{1}{2}v\xi \tag{4.1}$$

-continued $$h = b\sqrt{\frac{2\eta}{3}} \tag{4.2}$$

where the bit slenderness v=b/a and the definition of the number $\xi=\zeta'/\zeta$ is introduced. Since v=O(1), and $\xi$=O(10), the bit number $\eta$ is of order O(10) and the length h is a few multiples of the bit gauge height (recall that b is half the gauge length). The expression (4.1) for $\eta$ in terms of the cutter-rock interaction numbers $\zeta$ and $\zeta'$ (which can in principle be determined from single cutter tests) and the bit slenderness v provides an order of magnitude that is consistent from results of laboratory drilling tests where a full size bit is subject to combined lateral and axial loadings. However, no information appear to exist that would enable the estimation of h from experimental data. (Experimental determination of $H_o$ requires the measurements of both the angular penetration $\phi$ and the moment on the bit $\hat{M}$.)

Furthermore, by conceptualizing the cutting structure on the bit face by an equivalent blade of length a with a wear flat of uniform width $l_1$, it can be shown that in Regime I ($W<W^*=\sigma a l_1$), $G_1^I=0$ and $H_1^I=\zeta'\epsilon a$, and that in Regime II $W>W^*$), $G_1^{II}=\sigma a l_1$ and $H_1^{II}=\zeta\epsilon a$.

Bitmetrics

Assuming that the ratio $\sigma/\epsilon$ and the number $\xi$ vary little with the rock, the coefficients of the bit-rock interaction laws can be expressed as $H_1^I=A_1\epsilon$, $H_1^{II}=A_2\epsilon$, $H_2=A_3\epsilon$, $G_1^{II}=B_1\sigma$, and $H_0=C_1\epsilon$. Thus, for plane trajectories, five bit parameters can thus be identified: $A_1$, $A_2$, $A_3$ (dimension L), $B_1$ (dimension $L^2$), and $C_1$ (dimension $L^3$)

Let B designate the set of bit parameters $$B=\{A_1,A_2,A_3,B_1,C_1\} \tag{12}$$

The set of bit parameters B contains all the information needed to perform calculations for directional drilling.

iii) Mechanical Drill String Model

Formulation Within St-Venant Beam Theory

The Mechanical Drill String Model deals with the relationships between all the forces on the drill string (hook load, gravity, hydrodynamic forces, contact forces resulting from interaction with the borehole, active forces exerted by rotary steerable systems) and the forces and moment on the bit. This aspect of the problem is rather classical, as it involves the elastic response of the drill string, which is usually modeled within the framework of St-Venant beam theory (as an approximation of the more rigorous Kirchoff's theory).

The below equations establish that formulation of the bore hole evolution is complete when the mechanics of the drill string are taken into account. In considering these equations we restrict considerations to the reduced problem as set out in FIG. 1, namely the segment of BHA between the bit and the first stabilizer. Assuming that either the stabilizer is perfectly fitted to the borehole ($\overline{\theta}=\overline{\Theta}$), or that there is no jump of moment across the stabilizer ($[\overline{M}]=0$), meaning that the stabilizer is free to rotate in the plane of the borehole. In any case, the transverse displacement at the stabilizer can be considered to be equal to zero, and thus the transverse force $\overline{F}_2$ is generally discontinuous across the stabilizer. However, the stabilizer is free to move axially since all the frictional resistance is associated with the resisting torque at the stabilizer, hence $[\overline{F}_1]=0$. In other words, $\overline{F}_1$, the axial force above the stabilizer is fully transmitted to the bit.

Figure 9:
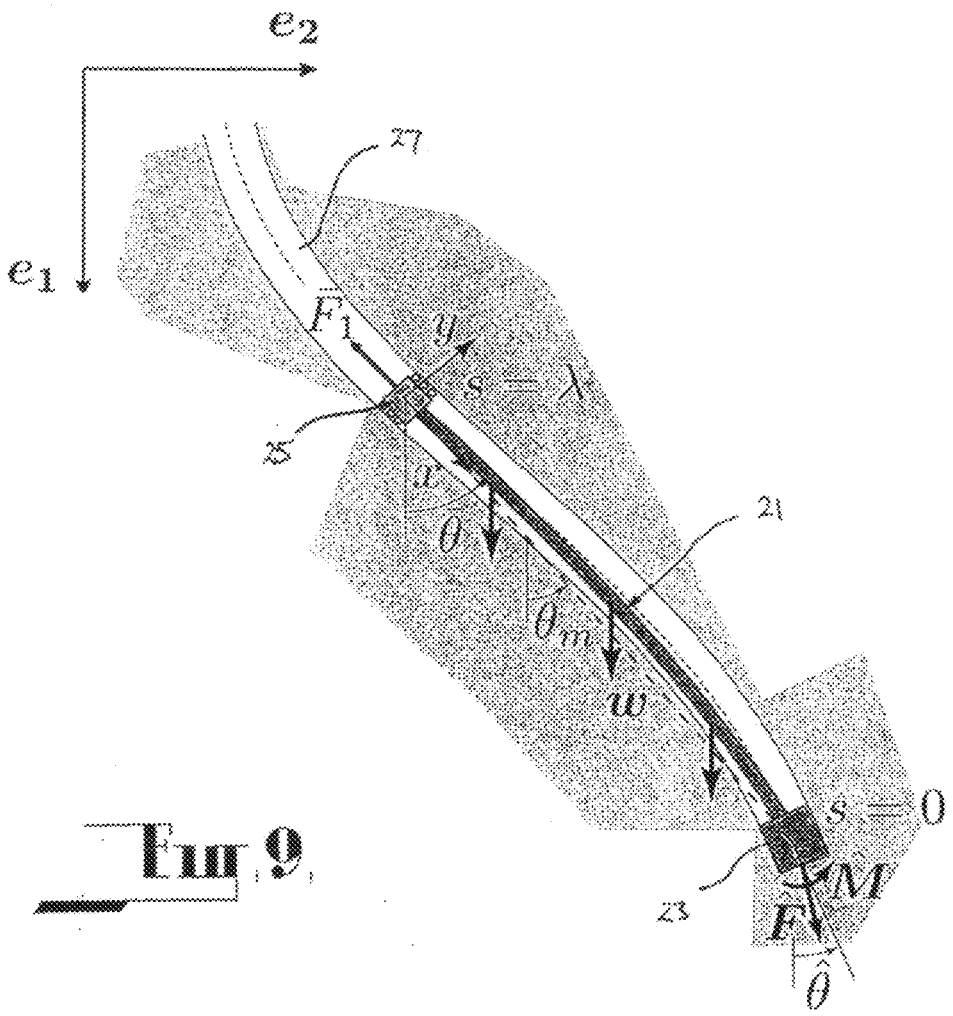
FIG. 9 is a view similar to FIG. 1 illustrating further parameters.

FIG. 9 illustrates the problem under consideration. The bit is at the end of the drill string at $s=\hat{s}=0$ and the stabilizer is located at $s=\overline{s}=\lambda$, where $\lambda$ is the fixed distance between the bit and the first stabilizer. The locations of these two points are known, since they are located on the borehole axis; in other words, the point $\hat{s}$ ($\overline{s}$) on the drill string curve coincides with the point $\hat{S}$ ($\overline{S}$) on the borehole curve ($\overline{S}=L-\lambda$, $\hat{S}=L$ L=l). In the fixed cartesian coordinates system defined by the two axes $e_1$ and $e_2$, the coordinates of the bit are $(\hat{X},\hat{Y})$ and those of the stabilizer are $(\overline{X},\overline{Y})$.

In order to analyze the deformation of the BHA with St-Venant beam theory, its reference configuration is taken to correspond to the chord linking the bit and the stabilizer. This chord is inclined by $\theta_m$ on the $e_1$-axis, given by (see FIG. 9)

$$\theta_m = \arctan\left(\frac{\hat{Y}-\overline{Y}}{\hat{X}-\overline{X}}\right). \tag{5.1}$$

Consider now the (x,y) coordinates system defined with its origin at the stabilizer and with the x-axis coinciding with the chord connecting the bit to the stabilizer and pointing towards the bit, see FIG. 9. In the (x,y) coordinates system, the bit is located at ($\lambda$,0) and the stabilizer at (0,0). Thus, the reference configuration of the BHA segment between the bit and the first stabilizer corresponds to the part of the x-axis defined by $0\le x\le\lambda$, y=0, and any deformation of the beam is reflected by a transverse deflection U(x), taken positive in the direction of the y-axis.

Following the classical beam notation, T is used to denote the transverse shear force acting on a cross-section of the beam. The sign convention is chosen so as to be consistent with the sign convention of the transverse force $F_2$ in the director basis. So within the approximation of beam theory, $\hat{T}=\hat{F}_2$ at the bit ($x=\lambda$) and $\overline{T}=\overline{F}_2$ at the stabilizer (x=0). Note, however, that the weight on bit $W=-\hat{F}_1$, so that it is positive.

Boundary Conditions and Loading

Four boundary conditions are needed to enable the determination of the transverse deflection U(x) from the governing equations. These conditions, two at each end, impose constraints on the deflection (U=0 at both ends) and either on the local rotation dU/dx of the beam or on the moment, which is proportional to $d^3U/dx^3$. The rotation dU/dx at either end of the beam must be understood at the inclination of the beam relative to the inclination of the chord linking the bit to the stabilizer. The beam rotation is measured positive, counterclockwise, like all the other angles defined so far.

The boundary conditions can be summarized as follows.

At the bit ($x=\lambda$):

$$U = 0 \tag{5.2}$$

$$\frac{dU}{dx} = \hat{\Theta} + \psi - \theta_m \tag{5.3}$$

At the stabilizer (x=0):

$$U = 0 \tag{5.4}$$

$$\frac{dU}{dx} = \overline{\Theta} - \theta_m \text{ or } \frac{d^2U}{dx^2} = 0 \tag{5.5}$$

The beam is subjected to gravity loading and possibly also to a transverse force $\check{F}$ applied to the RSS, at a distance $\check{s}$ from the bit. The force $\check{F}$ is positive if it is directed as the y-axis. If w denotes the weight per unit length of the beam, then the body force of magnitude w is inclined by an angle $-\theta_m$ on the x-axis, see FIG. 9.

Governing Equations

The equations governing the deflection of the beam consist of the fundamental relationship between the moment M and the curvature $d^2U/dx^2$, and the balance of forces and moments. They are summarized as follows.

Fundamental beam equation $$M = EI\frac{d^2U}{dx^2} \tag{5.6}$$

where E is Young's modulus (E=200 GPa for steel) and I is the area moment of inertia. For a pipe with an outer radius $r_2$ and inner radius $r_1$, I is given by, $$I = \frac{\pi}{4}(r_2^4 - r_1^4)$$

Moment equilibrium $$\frac{dM}{dx} + T = 0 \tag{5.7}$$

Transverse force equilibrium $$\frac{dT}{dx} + \breve{F}\delta(x - \lambda + \breve{s}) - w\sin\theta_m = 0 \tag{5.8}$$

where w is the weight per unit length of the BHA. For a pipe, $$w=\gamma\pi(r_2^2-r_1^2)$$

with γ denoting the specific weight of the material (γ=80 kN/m$^3$ for steel)

Axial force equilibrium $$\frac{dF_1}{dx} + w\cos\theta_m = 0 \tag{5.9}$$

Combine (6)-(8), to obtain $$EI\frac{d^4U}{dx^4} + w\sin\theta_m - \breve{F}_2\delta(x - \lambda + \breve{s}) = 0 \tag{5.10}$$

where δ(x) denotes the Dirac delta function. This equation can be solved with the boundary conditions (5.2)-(5.5).

The axial equilibrium is simply integrated to yield $$\hat{F}_1=\overline{F}_1-w\cos\theta_m \tag{5.11}$$

Scaling

The system of equations consisting of (5.10) and (5.2)-(5.5) can advantageously be scaled. First, the characteristic quantities for the length, deflection, force, and moment force, respectively denoted as L*, U*, F*, and M* are selected to be $$L_* = \lambda,\quad U_* = \frac{w\lambda^4}{EI},\quad F_* = w\lambda,\quad M_* = w\lambda^2 \tag{5.12}$$

The dimensionless position ξ, deflection u, shear force t, and moment m are then defined as $$\xi = \frac{x}{L_*},\quad ,u = \frac{U}{U_*},\quad t = \frac{T}{T_*},\quad m = \frac{M}{M_*} \tag{5.13}$$

With the scaling (5.12), the moment m and the shear force t are related to the deflection u according to $$m = \frac{d^2u}{d\xi^2},\quad t = -\frac{d^3u}{d\xi^3} \tag{5.14}$$

Furthermore, the dimensionless system of equations to be solved becomes $$\frac{d^4u}{d\xi^4} + \sin\theta_m - \Phi\delta(\xi - \Lambda) = 0 \tag{5.15}$$

$$u = 0,\quad \frac{du}{d\xi} = \Upsilon(\overline{\Theta} - \theta_m) \text{ or } \frac{d^2u}{d\xi^2} = 0 \text{ at } \xi = 0 \tag{5.16}$$

$$u = 0,\quad \frac{du}{d\xi} = \Upsilon(\hat{\Theta} + \psi - \theta_m), \text{ at } \xi = 1 \tag{5.17}$$

where Λ (the scaled distance between the stabilizer and the RSS pad) and Y (equal to the ratio L*/U*) are two numbers controlling the solution $$\Lambda = 1 - \frac{\breve{s}}{\lambda},\quad \Upsilon = \frac{EI}{w\lambda^3} \tag{5.18}$$

and Φ is the scaled force applied by the RSS $$\Phi = \frac{\breve{F}}{w\lambda} \tag{5.19}$$

Note that Y is a number, typically of order O(1~10).

The system of equations (5.15)-(5.17) can be readily be solved. With respect to the borehole evolution problem, the relevant elements of the solution are the expressions for the transverse force on the bit, $\hat{F}_2$, and for the moment on the bit, $\hat{M}$. In view of the linearity of the beam problem, it is in fact possible to write the solution $$\frac{\hat{F}_2}{w\lambda} = F_b\Upsilon(\hat{\Theta} + \psi - \theta_m) + F_s\Upsilon(\overline{\Theta} - \theta_m) + F_w\sin\theta_m + F_r(\Lambda)\Phi \tag{5.20}$$

$$\frac{\hat{M}}{w\lambda^2} = M_b\Upsilon(\hat{\Theta} + \psi - \theta_m) + M_s\Upsilon(\overline{\Theta} - \theta_m) + M_w\sin\theta_m + M_r(\Lambda)\Phi \tag{5.21}$$

The coefficients F's and M's are numbers, except those with a subscript r, which are functions of Λ. Also, these coefficients depend on the nature of the boundary condition at stabilizer; in particular, $F_s$=$M_s$=0 when ([$\overline{M}$]=0).

It is worth mentioning that the consideration of additional stabilizers will only be reflected in the particular expressions of the coefficients F's and M's. Also the solution (5.20)-

(5.21) assumes that there are no contact between the BHA and the borehole, other than at the bit and at the stabilizer.

The Model for Directional Drilling

Consider only the case of stationary solutions. The above mathematical model can be extended, using the same concepts, to the general case when (i) both the curvature K and the overgauge factor $\Xi$ evolve, (ii) there is lateral interaction between the bit and the rock, and (iii) the whole drill string is taken into account.

1. Equilibrium Borehole Trajectories

Segments of boreholes characterized by a constant radius of curvature and a constant diameter are practically significant. The cases actually correspond to the class of equilibrium solutions of the evolution equations (4), i.e., stationary solutions characterized by $dK/dS=0$ and $d\Xi/dS=0$ ($F(S)=G(S)=0$). Strictly speaking, stationary solutions for planar borehole trajectories do not exist, except for the trivial cases of a straight borehole, due to the changing orientation of the borehole with respect to the gravitational field. However, often the solution of the evolution equations as a sequence of stationary solutions can be approximated.

Figure 10:
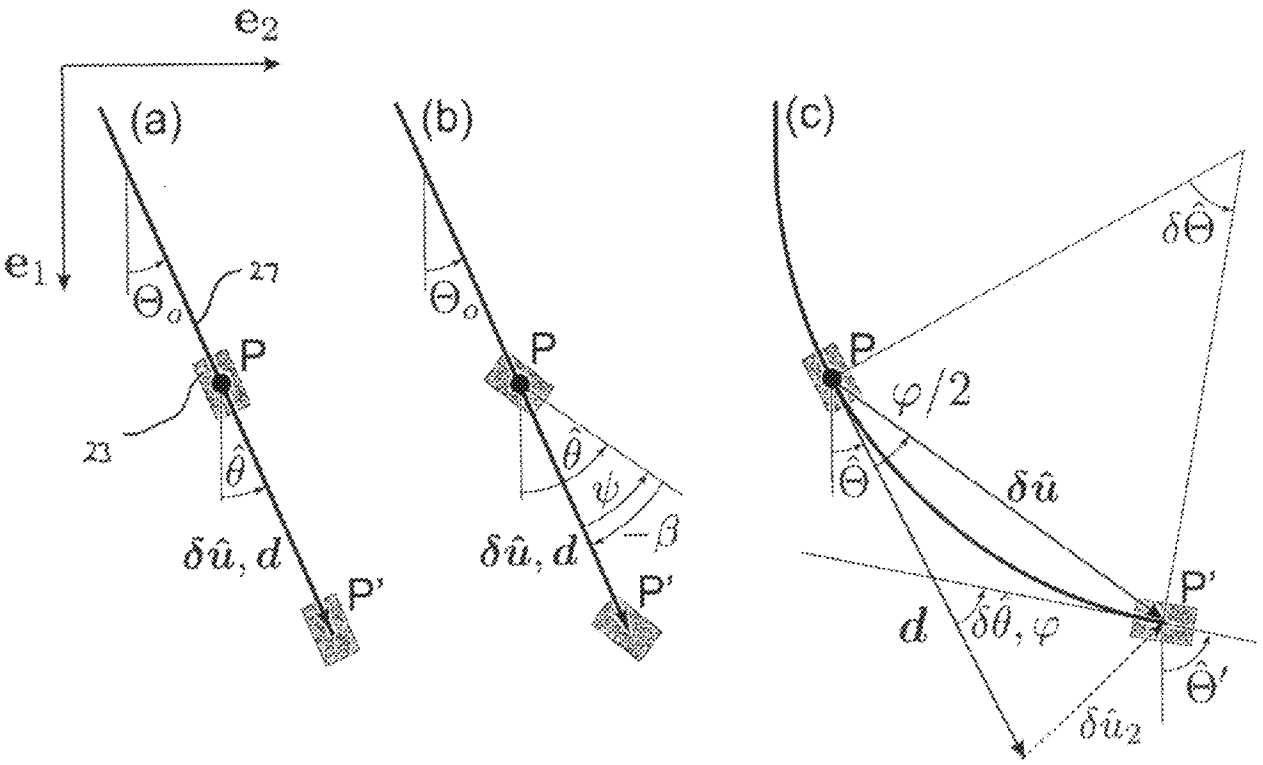
FIGS. 10*a*, 10*b*, 10*c* is a schematic view of different modes of bore hole propagation.

Consider the following particular cases, which are illustrated in FIG. 10.

Straight borehole, without lateral penetration: $d_1\neq 0$, $d_2=0$, $\phi=0$, see FIG. 10(*a*). This is the trivial case characterized by $\beta=\psi=0$; thus, $$\Theta=\Theta_o,\ \Xi=\Xi_o.$$

Straight borehole, with lateral penetration: $d_1\neq 0$, $d_2\neq 0$, $\phi=0$, see FIG. 10(*b*). Here the bit is drilling "crab-like", i.e. the bit inclined with a constant tilt on the borehole axis, and $\beta=-\psi\neq 0$. Hence, $$\Theta=\Theta_o,\ \Xi=\Xi_o+\nu|\beta|.$$

Curved borehole, without lateral penetration: $d_1\neq 0$, $d_2=0$, $\phi\neq 0$, see FIG. 10(*c*). In the particular case considered here, $\beta=\psi=0$, and $$K=\frac{\varphi}{d},\quad \Xi=\Xi_o.$$

Curved borehole, with lateral penetration: $d_1\neq 0$, $d_2\neq 0$. Here, $\beta=-\psi\neq 0$ and $$K=\frac{\varphi}{d},\quad \Xi=\Xi_o+\frac{2}{\pi}\nu|\beta|$$

2. Nature of the Stationary Solution

If the solution is stationary, the deformed shape of the BHA is invariant during drilling; in other words, the movement of the BHA can be viewed as a rigid body motion. Thus, the forces and moments on the bit are invariant, in the director basis attached to the bit, and therefore the penetration variables take a constant value for stationary solutions $$d=d_s,\ \beta=\beta_s,\ \phi=\phi_s \tag{6.1}$$

where the quantities with a subscript "s" are constant. It follows therefore that $$\delta d=\delta\beta=\delta\phi=0 \tag{6.2}$$

Hence, the borehole has a constant curvature $K=\hat{K}_s$ and a constant diameter $\Xi=\hat{\Xi}_s$, which, according to (2.4) and (2.7), are given by $$K=\frac{\varphi_s}{d_s},\quad \Xi=\Xi_o+\frac{2}{\pi}\nu|\beta_s| \tag{6.3}$$

3. Equations Governing the Stationary Problem

The system of equations to be solved for the stationary solutions consists of the relationships (2.1 and (3) between the borehole geometry and the penetration variables, the bit-rock interaction laws (4.0), and the solution (5.20)-(5.21) of the BHA problem. These equations can be further simplified, by using the knowledge that the borehole segment between the stabilizer and the bit is a circular arc. Thus, $\theta_m$ can be expressed as $$\theta_m=\frac{1}{2}(\hat{\Theta}+\overline{\Theta}) \tag{6.4}$$

and $\hat{\Theta}-\overline{\Theta}$ as $$\hat{\Theta}-\overline{\Theta}=K\lambda \tag{6.5}$$

After introducing the dimensionless curvature $\kappa$ $$\kappa=K\lambda \tag{6.6}$$

it can be written that $$\hat{\Theta}-\theta_m=\frac{\kappa}{2},\quad \overline{\Theta}-\theta_m=-\frac{\kappa}{2} \tag{6.7}$$

The final system of equations governing the equilibrium solution is summarized below. It has been assumed that drilling takes place in regime II, i.e., that the weight on bit W is larger than the threshold contact force $G_1^{II}$. (The stationary solution for regime I drilling would simply be obtained by using the appropriate value for $H_1$ and by setting $G_1=0$ in the equations for regime II.)

Bit-rock interaction:

$$W=G_1+H_1d_1,\ \hat{F}_2=-G_2-\eta H_1d_2,\ \hat{M}=-G_0-h^2H_1\phi \tag{6.8}$$

Relationship between bit penetration and borehole geometry:

$$\kappa=\frac{\varphi\lambda}{d},\quad \Xi=\Xi_o+\nu|\beta| \tag{6.9}$$

Drill string mechanics:

$$\frac{\hat{F}_2}{w\lambda}=\frac{1}{2}F_b\Upsilon(\kappa-2\beta)-\frac{1}{2}F_s\Upsilon\kappa+F_w\sin\theta_m+F_r(\Lambda)\Phi \tag{6.10}$$

$$\frac{\hat{M}}{w\lambda^2}=\frac{1}{2}M_b\Upsilon(\kappa-2\beta)-\frac{1}{2}M_s\Upsilon\kappa+M_w\sin\theta_m+M_r(\Lambda)\Phi \tag{6.11}$$

As shown next, the system of equations (6.8)-(6.11) is closed in terms of the unknown equilibrium curvature $\kappa$ and penetration inclination $\beta$.

4. Equilibrium Borehole Curvature and Radius

Both the equilibrium curvature $\kappa_s$ and overgauge $\Xi_s$, which is directly related to the penetration inclination $\beta_s$ (itself equal to the negative of the bit tilt $\psi_s$), can now be written.

First, the bit-rock interaction laws (6.8) and the penetration relationships (6.9) are combined, in order to express the lateral force on bit, $\hat{F}_2$, and the moment on bit $\hat{M}$ in terms of the weight on bit W. In doing so, the following approximations are used $$d_2 = \beta d_1, \quad \varphi = \frac{\kappa d_1}{\lambda} \tag{6.12}$$

both on account that $\beta \ll 1$. Hence, $$\hat{F}_2 = -G_2 - \beta\eta(W - G_1) \tag{6.13}$$

$$\hat{M} = -G_0 - \kappa\chi(W - G_1)\lambda \tag{6.14}$$

where the number $\chi$ is defined as $$\chi = \left(\frac{h}{\lambda}\right)^2 \tag{6.15}$$

Next, $\hat{F}_2$ and $\hat{M}$ are eliminated between (6.10), (6.11), (6.13) and (6.14), to yield a linear system of equations in terms of $\beta$ and $\kappa$ $$\begin{bmatrix} M_{\beta\beta} & M_{\beta\kappa} \\ M_{\kappa\beta} & M_{\kappa\kappa} \end{bmatrix} \begin{Bmatrix} \beta \\ \kappa \end{Bmatrix} = \begin{Bmatrix} N_\beta \\ N_\kappa \end{Bmatrix} \tag{6.16}$$

where the coefficients M's and N's are given by $$\begin{aligned} M_{\beta\beta} &= F_b\Upsilon - \eta(\Pi - \Gamma_1) \\ M_{\beta\kappa} &= \frac{\Upsilon}{2}(F_s - F_b) \\ M_{\kappa\beta} &= \Upsilon M_b \\ M_{\kappa\kappa} &= \frac{\Upsilon}{2}(M_s - M_b) - \chi(\Pi - \Gamma_1) \end{aligned} \tag{6.17}$$

and $$\begin{aligned} N_\beta &= \Gamma_2 + F_w \sin\theta_m + F_r(\Lambda)\Phi \\ N_\kappa &= \Gamma_0 + M_w \sin\theta_m + M_r(\Lambda)\Phi \end{aligned} \tag{6.18}$$

where $$\Gamma_1 = \frac{G_1}{w\lambda}, \Gamma_2 = \frac{G_2}{w\lambda}, \Gamma_0 = \frac{G_0}{w\lambda^2} \tag{6.19}$$

and $\Pi$ denotes the dimensionless weight on bit $$\Pi = \frac{W}{w\lambda} \tag{6.20}$$

It is interesting to note that the matrix of coefficients M is never diagonal, as only $M_{\beta\kappa}=0$ if $\bar{\theta}=\bar{\Theta}$.

The equilibrium solution $\kappa_s$ and $\beta_s$ then deduced from (6.14) to be $$\beta_s = \frac{M_{\kappa\kappa}N_\beta - M_{\beta\kappa}N_\kappa}{M_{\beta\beta}M_{\kappa\kappa} - M_{\beta\kappa}M_{\kappa\beta}}, \kappa_s = \frac{M_{\beta\beta}N_\kappa - M_{\kappa\beta}N_\beta}{M_{\beta\beta}M_{\kappa\kappa} - M_{\beta\kappa}M_{\kappa\beta}} \tag{6.21}$$

It is expected that the penetration angle $\beta$ to be of order $O(10^{-2})$ and the dimensionless curvature $\kappa$ to be of order $O(10^{-2}\sim10^{-1})$. An examination of the system of equations (6.16) shows that the right-hand side members are of order $O(10^{-1}\sim1)$ and that the diagonal terms of the matrix M are of order O(1~100), so it appears that the appropriate order of magnitude can be recovered for $\beta$ and $\kappa$.

However, an extensive parametric analysis is needed to understand the dependence of $\beta$ and $\kappa$ on the various parameters of the system. Nonetheless, it can already be seen that two terms are controlling the diagonal terms of the M matrix, namely the dimensionless bending modulus Y and the dimensionless weight on bit $\Pi-\Gamma_1$ that is associated with rock cutting. Both are actually O(1~10), and thus depending on the balance between these two terms, there could be two limiting situations, one with a strong influence of the BHA and another one where the features of the BHA are irrelevant.

It is therefore natural to introduce the number $\Psi$ defined as $$\Psi = \frac{\Upsilon}{\Pi - \Gamma_1} = \frac{EI}{\lambda^2(W - G_1)} \tag{6.22}$$

to characterize the relative stiffness of the BHA. If $\Psi$ is small enough, say $\Psi$0.1, the equilibrium solution does not depend on the characteristics of the BHA, as it is too flexible.

5. Equilibrium Solution: Summary

It is appropriate to summarize the sequence of operations needed to calculate the equilibrium curvature $K_s$ and the equilibrium radius of the borehole.

1. Required information
   - Bit geometry: radius a, slenderness v;
   - Characteristics of the BHA: inclination $\theta_m$, weight per unit length w, length $\lambda$, Young's modulus E, moment of inertia I, distance of the RSS pad from the bit $\check{s}$;
   - Bit-rock interaction: parameters $G_0$, $G_1$, $G_2$, $H_0$, $H_1$, $H_2$;
   - Loading: weight on bit W and RRS force $\check{F}$;
2. Calculate the numbers $\eta$, $\chi$, Y, $\Lambda$, $\Gamma_0$, $\Gamma_1$, $\Gamma_2$ that control the equilibrium solution, besides $\theta_m$ $$\eta = \frac{H_2}{H_1}, \chi = \frac{H_0}{H_1\lambda^2}, \Upsilon = \frac{EI}{w\lambda^3}, \Lambda = 1 - \frac{\check{s}}{\lambda},$$

$$\Gamma_0 = \frac{G_0}{w\lambda^2}, \Gamma_1 = \frac{G_1}{w\lambda}, \Gamma_2 = \frac{G_2}{w\lambda}$$

3. as well as the loading parameters; namely, the weight on bit $\Pi$ and the RSS force $\Phi$, $$\Phi = \frac{\check{F}}{w\lambda}, \Pi = \frac{W}{w\lambda}$$

4. Compute the equilibrium curvature $K_s$ and radius $A_s$ of the borehole from $$K_s = \frac{\kappa_s}{\lambda}, A_s = a(1 + \Xi_o + v|\beta_s|)$$

5. where the equilibrium solution $\kappa_s$ and $\beta_s$ is given by (6.21).

6. Example

Consider the following numerical values: a=0.1 m, v=2, $\theta_m=1$, $w=10^3$ N/m, $\lambda=10$ m, $EI=10^7$ N·m$^2$, $\check{s}=1$ m, $G_0=G_2=0$, $G_1=10^4$ N, $H_0=10^9$ N·m, $H_1=10^7$ N/m, $H_2=10^8$ N/m, $W=10^5$ N, $\check{F}=-10^4$ N. Then, the values of the control numbers are: $\eta=10$, $\chi=1$, Y=10, $\Lambda=0.9$, $\Gamma_0=0$, $\Gamma_1=1$, $\Gamma_2=0$, and the loading parameters are $\Pi=10$, $\Phi=-1$. Hence, $\kappa_s=-1.16\cdot10^{-2}$ and $\beta_s=-9.28\cdot10^{-3}$ if $\overline{\theta}=\overline{\Theta}$ and $\kappa_s=-9.24\cdot10^{-3}$ and $\beta_s=-1.37\cdot10^{-2}$ if $[\overline{M}]=0$. These values translate into a radius of curvature R and borehole radius A given by R=863 m and A=0.1029 m for the case $\overline{\theta}=\overline{\Theta}$ and by R=1082 m and A=0.1038 m for the case $[\overline{M}]=0$, assuming $\Xi_o=0.01$.

Determination of the Bitmetrics Coefficients

The bitmetrics coefficients can be determined experimentally or theoretically.

Experimental Determination of the Bitmetrics Coefficients

The bitmetrics coefficients can be determined experimentally with a custom designed laboratory apparatus that allows the conduct of kinematically controlled drilling experiments. Unlike standard laboratory equipment used to test drill bits for the petroleum industry—in which drilling is performed under prescribed axial force (weight-on-bit) and rotary speed, drilling experiments for the purpose of determining the bitmetric coefficients will be performed under prescribed velocities, $v_1$ (rate of axial penetration), $v_2$ (rate of transverse penetration), and $\omega$ (rate of angular penetration). The equipment will therefore have the ability to impose an angular penetration to the bit. Since minimum vibrations are expected to be induced in kinematically controlled experiments, the bit-rock interaction law can be determined with accuracy and high resolution in such experiments. (By high resolution, it is meant that the force averaging requires only a few revolutions of the bit, provided that the material being drilled is homogeneous.)

By measuring the forces and moment on the bit during the conduct of a kinematically controlled test, it is possible to extract the bitmetrics parameters.

Figure 11:
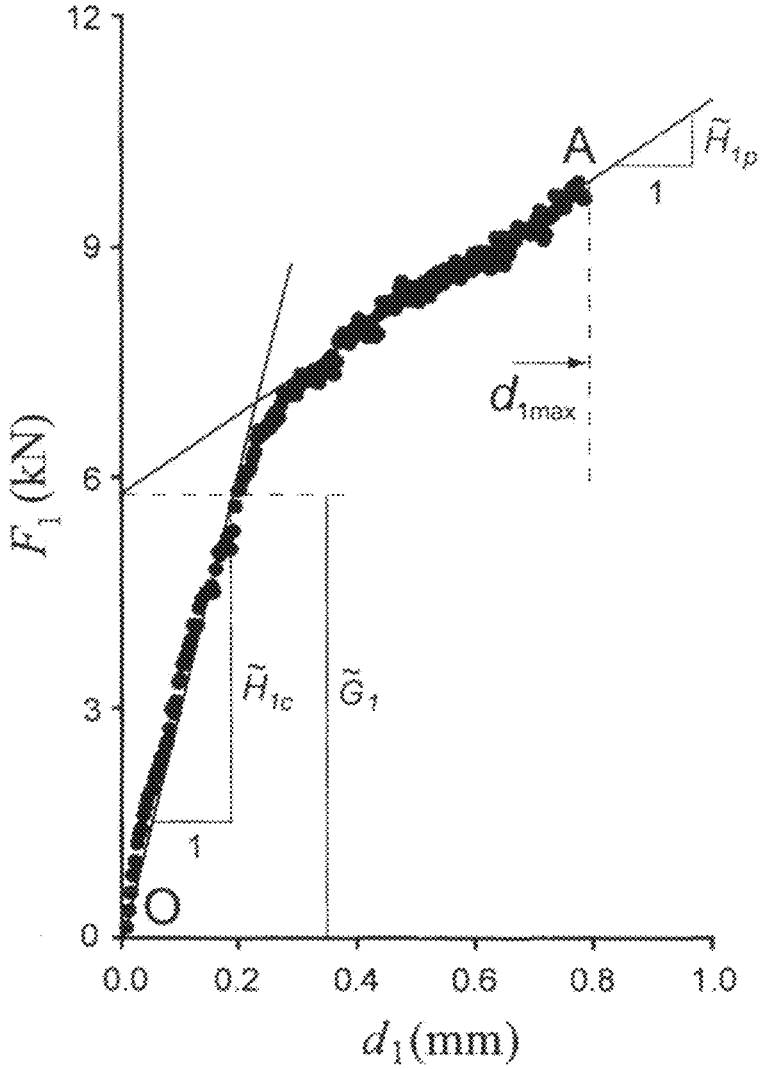
FIG. 11 is a graphical representation of the axial response of a bit according to changes in force.

As an example, consider the simple case of axial penetration ($v_1\neq0$, $v_2=0$, $\omega=0$). The axial force-penetration response, $F_1$ versus $d_1$ is illustrated in FIG. 11. Using a kinematically controlled drilling device, the complete response curve can be directly measured by monotonically increasing the penetration rate during drilling, for example at a constant acceleration rate $\eta_1$. If the angular velocity $\Omega$ of the bit is kept constant, the acceleration rate $a_1$ required to measure the response curve up to $d_1=d_{1max}$ using a drilling length L with $v_1$ increasing linearly with time, is given by $$\eta_1=\frac{2L}{t_{1max}^2},\ t_{1max}=\frac{4\pi L}{\Omega} \tag{7.0}$$

where $t_{1max}$ is the time required to drill over a distance L, while noting that $v_1=\Omega d_1/2\pi$. Thus by increasing the penetration velocity $v_1$ from 0 to $v_{1max}$ at a constant rate $\eta_1$, the segment OA of the bit-rock interaction curve illustrated in FIG. 11 can be measured. Measurement of this response curve over a drilling distance L requires n revolutions of the bit, with n (typically less than 100) given by:

$$n=\frac{1}{2\pi}\Omega t_{1max}=\frac{2L}{d_{1max}} \tag{8.0}$$

For instance, taking $d_{1max}$=1 mm and n=100, drilling will take place over the distance L=200 mm. Since the drilled material parameters $\epsilon$, $\epsilon'$, and $\sigma$ can be independently measured from single cutter experiments, the bitmetrics parameters $H_{1c}$, $H_{1p}$, $G_1$ can readily be computed from the measured coefficients $\tilde{H}_{1c}$, $\tilde{H}_{1p}$, $\tilde{G}_1$ shown in FIG. 11 according to $$H_{1c}=\tilde{H}_{1c}/\epsilon',\ H_{1p}=\tilde{H}_{1p}/\epsilon',\ G_1=\tilde{G}_1/\sigma \tag{9.0}$$

The other bitmetrics parameters can be measured from similar experiments conducted by imposing non-zero transverse penetration rate $v_2$ and angular penetration rates $\omega$. The methodology follows in spirit the procedure outlined above to identify the bitmetrics coefficients characterizing the axial bit-rock interaction law. Note that the bitmetrics parameters can be determined from kinematically controlled experiments in which the penetration velocities ($v_1$, $v_2$, and $\omega$) are either continuously varied or are set at a few discrete values. Note also that change in the penetration per revolution can also be achieved by altering the angular velocity $\Omega$.

Experimental Apparatus

Figure 12:
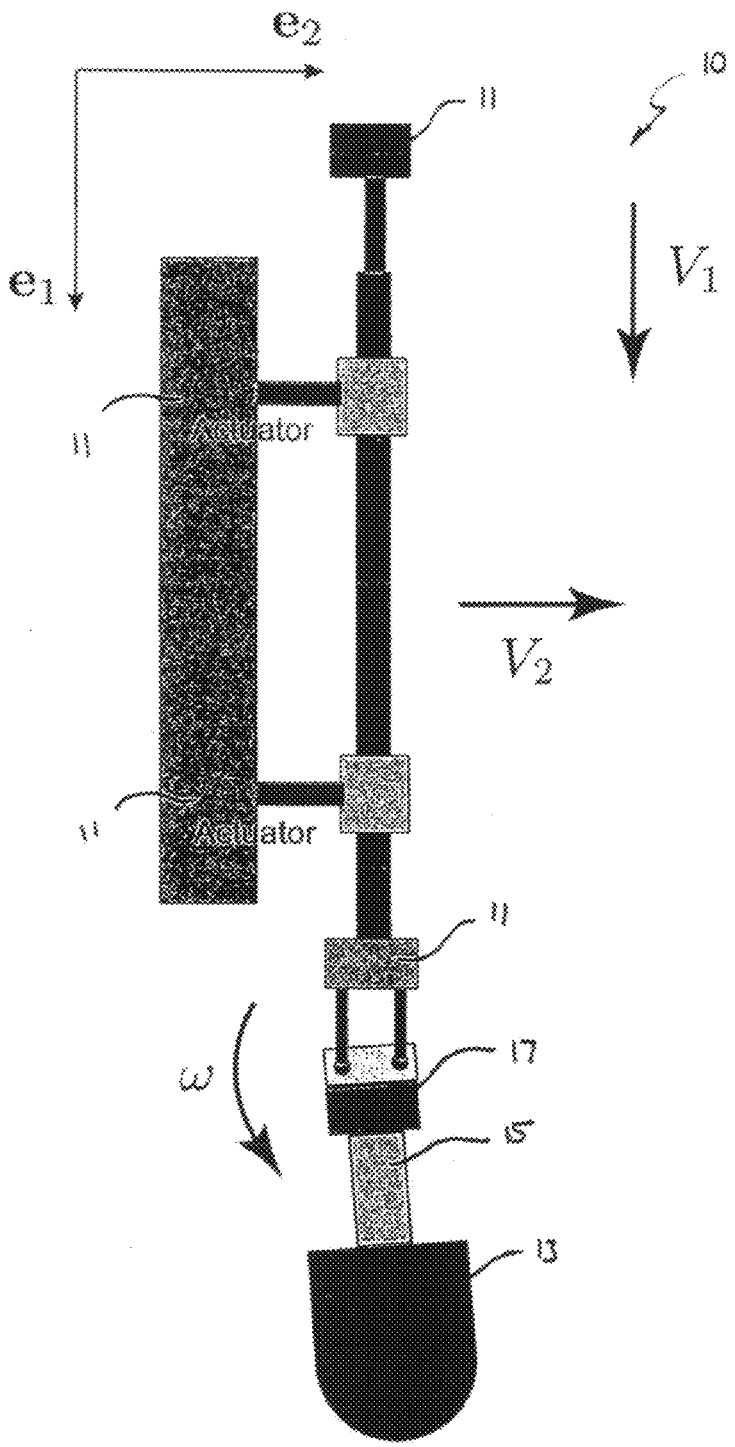
FIG. 12 is a schematic side view of an apparatus

The principle of an apparatus 10 to measure the bitmetrics coefficients from kinematically controlled experiments is shown in FIG. 12. A system of controlled actuators 11 allows the apparatus 10 to impose an arbitrary planar trajectory to the bit 13. The bit 13 is directly mounted on an electric motor 15 that can impart an angular velocity $\Omega$ to the bit 13 around its axis of revolution. The forces and moment on the bit 13 are measured by a multi-axes load cell 17. Since the translation actuators 11 are parallel to the axes of the fixed system of reference ($e_1$, $e_2$), the axial penetration rate $v_1$ is not equal to the velocity $V_1$ of the vertical actuator 11 (and similarly $v_2\neq V_2$) if the bit 13 is inclined to the vertical axis $e_1$. Similarly, a correction needs to be accounted for if the center of rotation for the angular penetration is not directly related to the bit face, as in the sketch of FIG. 12. Nonetheless, by servo-controlling the actuators 11 of the apparatus, any prescribed (realistic) history of the penetration rates ($v_1$, $v_2$, and $\omega$) can be implemented.

Figure 13:
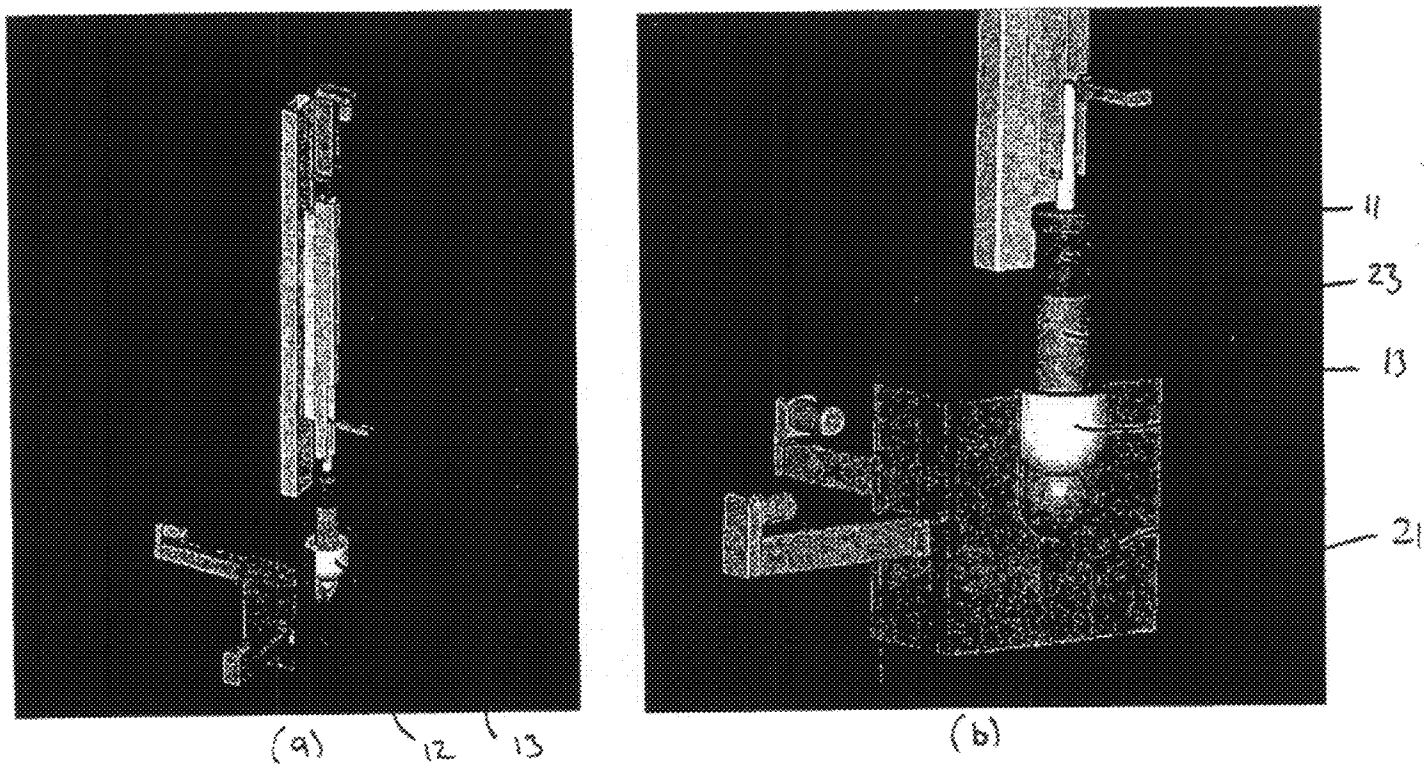
FIGS. 13*a*, 13*b* is a further embodiment of an apparatus to measure bit parameters.

An alternative concept of the apparatus is shown in FIGS. 13*a* and 13*b*. The main difference with the previous concept lays in the imposition of the horizontal velocity. Here the rock specimen 21 can be moved horizontally and in two orthogonal directions, while the drilling rod 23 can only move in the vertical direction. Also the rotation of the bit 13 involves only one actuator 11.

Theoretical Determination of the Bitmetrics Coefficients

Figure 14:
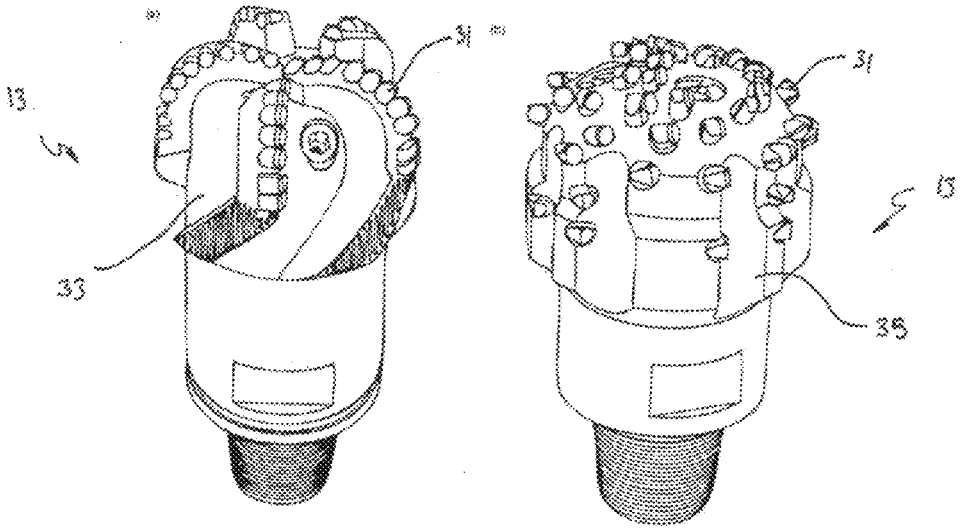
FIGS. 14*a*, 14*b* are two drill bits of different configuration.

Given a bit design, such as the ones shown in FIG. 14, the bitmetric coefficients can be assessed using a computational algorithm. The lumped bit parameters are essentially related to the positioning of the cutters 31 on the bit body 33, the orientation and distribution of the chamfers 35 and wearflats 37, the shape of the cutting edge 39, and the length and nature of the gauge 41.

The bitmetrics coefficients can be computed by subjecting the bit 13 to a set of virtual motions (i.e., axial and lateral translation, angular rotation) and computing the corresponding global forces and moment on the bit 13. This is done by summing up the forces on each cutter 31. Since the bitmetrics coefficients are only meaningful when the response of the bit 13 is averaged over one revolution, the forces and moments on the bit have to be computed by integrating the forces on the cutters 31 over a complete bit revolution. The approach is based on the recognition that the penetration and contact at each cutter 31 are not only local but also independent processes.

The steps of the proposed methodology to compute the bitmetrics coefficients are described using the axial response law as follows. As when experimentally determining the bitmetrics coefficients as described above, a penetration velocity which increases linearly with time is adopted. Since time is arbitrary, it is actually convenient for the calculations to use the angle of rotation of the bit around its axis of revolution, $\Phi=\Omega t$, as evolution parameter. Let $u_1(\Phi)$ denote then the distance drilled as a function of $\Phi$. Note that $$\frac{du_1}{d\Phi}=\frac{v_1}{\Omega} \tag{10.0}$$

Choosing $$u_1=a\Phi^2 \tag{11.0}$$

implies that the incremental penetration of the bit, $dd_1$, after a rotation $d\Phi$ is given by $$dd_1=2a\Phi d\Phi \tag{12.0}$$

For computational purposes, a discrete increment $\Delta\Phi=2\pi/k$ is considered. Let i denote the increment index, so that the rotation angle $\Phi_i$ at index i is given by $$\Phi_i=i\Delta\Phi=2\pi i/k \tag{13.0}$$

Let also $\Delta d_{ui}$ denote the incremental axial penetration of the bit associated to an angular increment $\Delta\Phi$ at index i. It follows from (12.0) that $$\Delta d_{1i}=2a\Phi_i\Delta\Phi=8a\pi^2 i/k^2 \tag{14.0}$$

The calculations proceed with i increasing by step of 1 from 0 to a maximum value $i_{max}$ such that $k\Delta d_{1imax}=d_{1max}$, as the penetration of the bit after one revolution will then have become equal to $d_{1max}$.

At each step of computations, the forces on each cutter can be computed, knowing the amount of material to be removed by each cutter. These cutters forces can then be used to compute the overall force and moment on the bit at this particular step. The average force and moment on the bit after one revolution are finally obtained by averaging over k steps, the force and moment computed at each step.

The computed force and moment response to the prescribed bit motion, with the forces and moment averaged over one revolution of the bit, can be interpreted in terms of the lumped parameters, as in a laboratory experiment.

Bit Anisotropy

Figure 15:
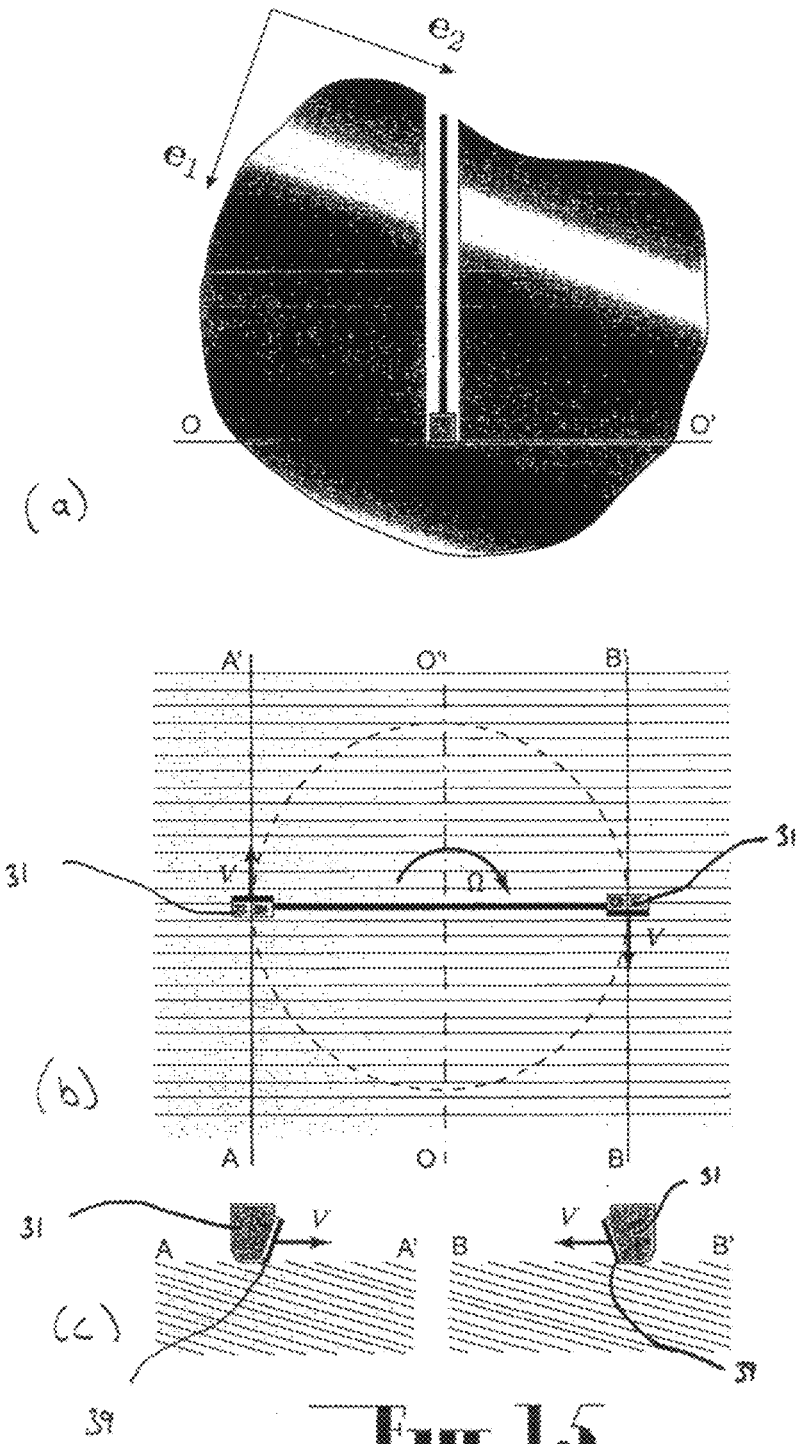
FIG. 15*a*, 15*b*, 15*c* is a schematic view of a bit passing through earth formation inclined to the earth's stratification.
Figure 16:
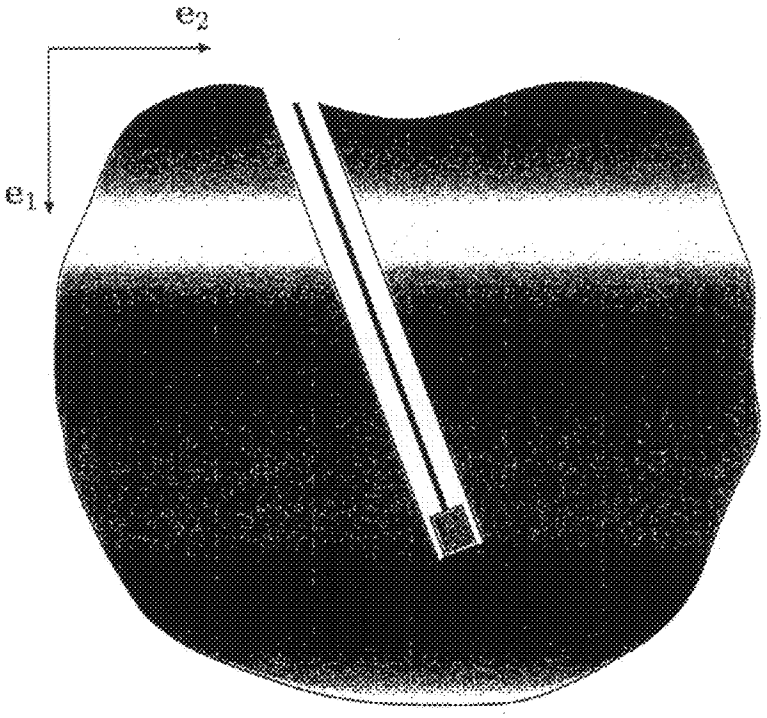
FIG. 16 is a graphical explanation of the moment arising on the bit face due to the anisotropy of the rock.

Referring to FIG. 15, inclination of the bit axis with respect to the stratification, can readily be accounted for by the above discussed approach. Consider two prototypical situations that are distinguished by the magnitude of the mean distance b between bedding planes relative to the bit radius a. If b/a<<1, the rock (typically a shale) is treated as anisotropic. However, if b/a~1, the rock is defined as "thinly" layered. The first instance is the most common, as drilling in shales typically represents 60% to 75% of the linear footage of a borehole. In both cases, there is a resisting moment at the bit when there is no angular penetration in contrast to situations where the rock can be assumed to be isotropic and homogeneous (at a scale at least a couple of times larger than the bit radius). As discussed below, the resisting moment $\hat{M}$ arises from a force imbalance on the cutters that is associated with the inclination of the bit with respect to the planes of stratification.

Consider first the case of anisotropic rocks. FIG. 15*b* illustrates the two positions of a cutter 31 on the rotating bit 13, when the cutter edge 39 is parallel to the stratification, i.e., when the cutter 31 is either located on the AA' or on the BB' segments (which are in the plane orthogonal to the bit axis). Experiments on a single cutter 31 indicate that the forces on the cutter 31 depend on whether the tool is cutting rock from A to A' (i.e., across the stratification) or from B' to B, all other conditions being equal. Thus, when the forces on all the cutters 31 are summed up and integrated over one revolution, there is a residual moment $\hat{M}$ about the axis OO', that results from the force imbalance when $\phi=0$.

Figure 17:
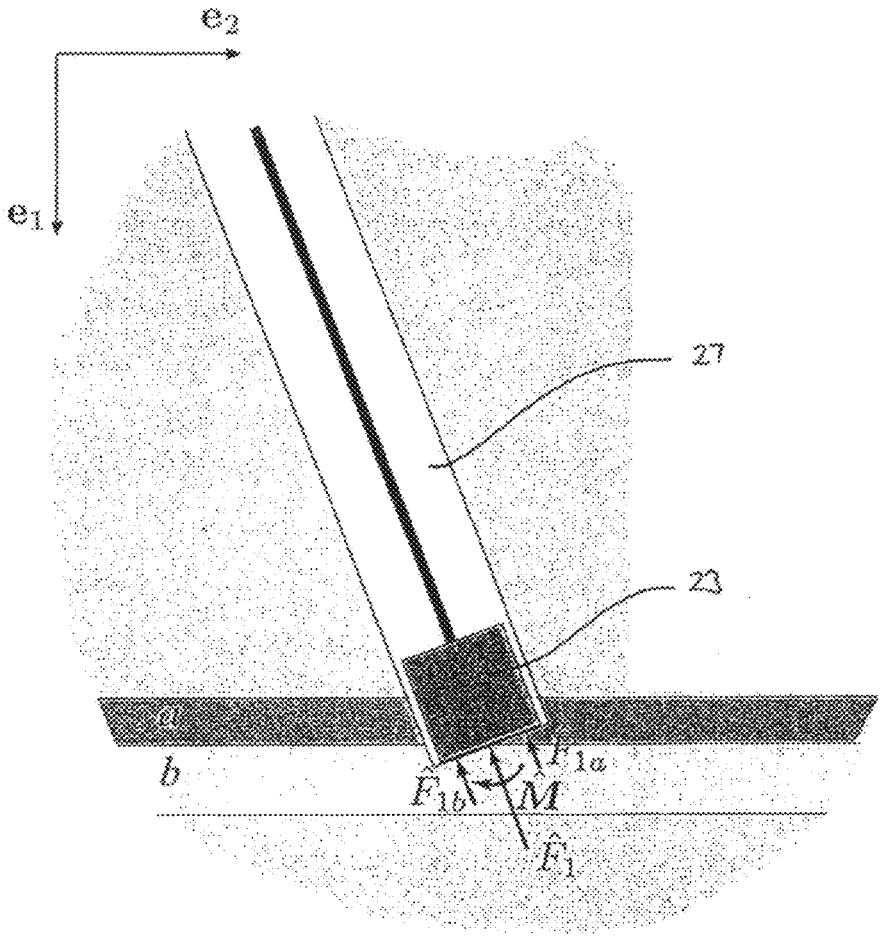
FIG. 17 is a view similar to FIG. 15 with the drill bit passing through different geological layers.

In the case of the layered rock shown in FIG. 17, there is also a force imbalance that is now caused by the simultaneous engagement of the bit 13 into two different layers a and b, characterized by different strength. Drilling through this layered system thus gives rise to an unsymmetrical axial force distribution across the bit face (when averaged over one revolution of the bit), that reduces not only to an axial force $\hat{F}$ but also to a moment $\hat{M}$ when the bit is drilling straight ahead ($\phi=0$). It should be noted that $\hat{M}$ acts here around an axis parallel to the intersection of plane containing the bit face and the interface between the two layers. Thus, the moment on the bit $\hat{M}$ is directed along different directions, orthogonal to each other, when comparing the anisotropic and layered rock cases for identical orientations of the stratification and the borehole.

A moment on the bit can be induced solely by the anisotropy and/or the layered structured of the rock, which could ultimately cause a deflection of the planned bit trajectory. It is obviously essential to account for the existence of a moment on the bit (and its conjugated kinematical quantity $\phi$) to model to the effect of anisotropy and/or layering. The introduction of these supplementary quantities allows quantifying of the anisotropy/layer effects from basic knowledge about the interaction between a single cutter and the rock, without resorting to the ad hoc introduction of a "bit anisotropy", as done in the traditional approaches.

Comparison with Previous Approaches

The key difference between the model described in this specification and other models proposed in the prior art is the introduction of a moment on the bit, $\hat{M}$, and its conjugate kinematic variable, the angular penetration $\phi$, as well as a relationship between $\hat{M}$ and $\phi$. Furthermore, a distinction is drawn between the contact and the penetration mode of interaction between the bit and the rock.

In contrast, models used in the art, rely on a linear relationship between the forces components $\hat{F}_1$ and $\hat{F}_2$ and the penetration variables $d_1$ and $d_2$ as shown below:

$$\begin{Bmatrix} \hat{F}_1 \\ \hat{F}_2 \end{Bmatrix} = \begin{bmatrix} K_1 & K_{12} \\ K_{21} & K_2 \end{bmatrix} \begin{Bmatrix} d_1 \\ d_2 \end{Bmatrix}$$

where coupling terms $K_{12}$ and $K_{21}$ account for situations when the axis of the drill bit is inclined with respect to the stratification, as shown in FIG. 17.

Furthermore, in models used in the art, the bit is either fixed in rotation ($\phi=0$) or is free to rotate ($\hat{M}=0$)

The introduction of $\hat{M}$ and $\phi$ is essential as it enables one to relate naturally the curvature of the borehole to the penetration variable. In other words, the radius of curvature of the borehole is proportional to a length scale equal to the ratio of the moment on the bit over the weight on bit (or to a generalization of this ratio). In the current models, the radius of curvature is proportional to an ad hoc length scale, typically about 10 m, but that can be adjusted to fit field data.

Furthermore, the introduction of $\hat{M}$ and $\phi$ enables one to naturally account for the anisotropy of the formation or for different layers in the formation (with thicknesses of order the bit radius), which is currently accounted for in an ad hoc way via the introduction of the coupling terms $K_{12}$ and $K_{21}$, as indicated above.

Modifications and variations such as would be apparent to the skilled addressee are considered to fall within the scope of the present invention.

Throughout the specification, unless the context requires otherwise, the word "comprise" or variations such as "comprises" or "comprising", will be understood to imply the inclusion of a stated integer or group of integers but not the exclusion of any other integer or group of integers.

The claims defining the invention are as follows:

1. A method of predicting a well trajectory wherein the method utilises a series of parameters to calculate the trajectory characterised in that the parameters include the angle of a drill bit relative to a well bore, and the variation of said angle during drilling wherein the variation of said angle is related to the moment on the bit.

2. A method to characterize a drill bit for directional drilling so as to provide the bit with a set of lump parameters, the lump parameters identifying the relationship between the angular, axial and lateral penetrations of the bit and the forces and moment on the bit when cutting into a particular rock formation, wherein the lump parameters are used to determine the required drill bit design given the rock formation.

3. The method according to claim 2 wherein the lump parameters identify the drill bit design required when directional drilling with a particular rotary steerable system.

4. A method of determining a set of lump parameters for a drill bit, the method comprises:

placing the bit on a test rig, allowing the bit to engage a rock formation of known properties whereby the bit rotates relative to the rock formation;

applying a kinematically controlled motion to the bit that results in a combination of axial penetration ($d_1$), lateral penetration ($d_2$), and angular penetration ($\phi$) of the bit into the rock;

measuring the resultant forces $\hat{F}_1$ and $\hat{F}_2$, where $\hat{F}_1$ is the axial force on the bit, and $\hat{F}_2$ is the lateral force on the bit;

performing best fit of data and obtain values of the coefficients G and H from best fit wherein:

$$\hat{F}_1=H_1^I d_1 \text{ if } \hat{F}_1 \text{ is proportional to } d_1$$

or $$\hat{F}_1=G_1^{II}+H_1^{II}d_1 \text{ if } \hat{F}_1>G_1^{II}$$

and $$\hat{F}_2=H_2 d_2$$

excluding the intrinsic specific energy $\epsilon$, and the contact strength $\sigma$ of the rock formation from consideration to determine values for lump parameters $A_1$, $A_2$, $A_3$, and $B_1$ independent of the rock, whereby $$G_1^{II}=B_1\sigma$$

$$H_1^I=A_1\epsilon,\ H_1^{II}=A_2\epsilon,\ H_2=A_3\epsilon;$$

measuring the moment on the bit $\hat{M}$ performing best fit of data to determine values of the coefficients $H_o$, given that $$\hat{M}=H_0\phi,$$

excluding the intrinsic specific energy $\epsilon$, of the rock formation from consideration to determine lump parameters $C_1$, $$H_0=C_1\epsilon,;$$

so as to provide a set of five lump parameters for that given bit, $$B=\{A_1,A_2,A_3,B_1,C_1\}.$$

5. The method according to claim 4 comprising the further step of determining the expected trajectory of the well when drilling with a drill bit having the set of lump parameters B.

6. A test rig for exerting motion on a bit cutting into a specimen of which the properties are known, the test rig having means to measure the resultant forces and moments placed upon a drill bit, wherein the test rig is adapted to cause the bit to undergo an axial velocity, a lateral velocity and/or an angular velocity.

7. The test rig according to claim 6 wherein the test rig is adapted to cause the specimen to move relative to the bit.

8. The test rig according to claim 6 wherein the specimen rotates relative to the bit whilst the axial, lateral and/or angular velocity is applied to the bit.

9. The test rig according to claim 6 wherein the specimen moves horizontally in two orthogonal directions while the bit is restricted to move in the vertical direction only.

10. A method to calculate the effect of a formations anisotropy on a borehole trajectory, the method comprises:

assessing the variation of the specific energy $\epsilon$ and of the contact strength $\sigma$ of the rock formation with respect to the direction of motion of a cutter of a drill bit relative to the axis of transverse isotropy of the rock;

computing the forces on each cutter of the bit and averaging the forces over one revolution of the bit;

computing the residual moment on the bit, $\hat{M}_r$, from the average cutter forces;

subtracting $\hat{M}_r$ from the moment on the bit $\hat{M}$ to compute the effective moment $\hat{M}_e=\hat{M}-\hat{M}_r$;

using $\hat{M}_e$ in bit-rock interaction laws to determine the behavior of the bit through an isotropic formation.

11. A method to calculate the effect of a layered formation on a bore hole trajectory, when the layer thickness is comparable to the radius of a bit, the method comprises:

assessing the specific energy $\epsilon$ and of the contact strength $\sigma$ within each of the layers which are simultaneously drilled by a bit, when the axis of the bit is inclined on the normal to the planes of stratification;

computing the forces on each cutter of the bit and averaging the forces over one revolution of the bit computing the residual moment on the bit, $\hat{M}_r$, from the average cutter forces;

subtracting $\hat{M}_r$ from the moment on the bit $\hat{M}$ to compute the effective moment $\hat{M}_e=\hat{M}-\hat{M}_r$;

using $\hat{M}_e$ in bit-rock interaction laws to determine the behavior of the bit through the layered formation.

12. A method for characterizing a drill bit, the method comprises:

imposing a combination of motions on the bit;

determining the force(s) and moment(s) acting on the bit;

computing a set of lump parameters relative to that bit wherein the parameters characterize the bit.

13. The method according to claim 12 wherein the step of imposing the combination of motions comprises imposing an axial velocity relative to the bit, a lateral velocity relative to the bit and/or an angular velocity relative to the bit.

14. The method according to claim 12 wherein the step of determining the force(s) and moment(s) comprises the determination of the axial force, lateral force and moments acting on the bit.

15. The method according to claim 12 wherein the step of determining the moment(s) acting on the bit comprise the determination of the moment(s) on the bit generated as a result of the bits orientation relative to a borehole.

16. A method for characterizing a drill bit, the method comprises:

determining the force(s) and moment(s) acting on the bit;

computing a set of lump parameters relative to the bit wherein the parameters characterize the bit.

17. A method for characterizing a drill bit having a plurality of cutters, the method comprises:

determining the characteristics of each cutter;

summing the characteristics of each cutter and accounting for the geometrical layout of the cutter on the bit face as well as the geometry of a gauge pad on the bit to provide the set of lump parameters for the bit to enable the bit to be characterized.

18. A method of determining a equilibrium curvature $K_s$ and equilibrium radius of a borehole, the method comprises:

determining the radius a and slenderness v of a drill bit;

determining the characteristics of a bottom hole assembly (BHA) being inclination $\theta_m$, weight per unit length w, length $\lambda$, Young's modulus E, moment of inertia I, distance of the rotary steerable system (RSS) pad from the bit $\check{s}$;

determining the bit-rock interaction being parameters $G_0$, $G_1$, $G_2$, $H_0$, $H_1$, $H_2$;

determining the weight on bit W and RSS force $\check{F}$;

calculating the numbers $\eta$, $\chi$, Y, $\Lambda$, $\Gamma_0$, $\Gamma_1$, $\Gamma_2$ that control the equilibrium solution, $$\eta = \frac{H_2}{H_1},\ \chi = \frac{H_0}{H_1\lambda^2},\ \Upsilon = \frac{EI}{w\lambda^3},\ \Lambda = 1 - \frac{\check{s}}{\lambda},$$

-continued $$\Gamma_0 = \frac{G_0}{w\lambda^2},\ \Gamma_1 = \frac{G_1}{w\lambda},\ \Gamma_2 = \frac{G_2}{w\lambda}$$

calculating the loading parameters being the weight on bit $\Pi$ and the RSS force $\Phi$, $$\Phi = \frac{\check{F}}{w\lambda},\ \Pi = \frac{W}{w\lambda}$$

calculating the equilibrium curvature $K_s$ and radius $A_s$ of the borehole from $$K_s = \frac{\kappa_s}{\lambda},\ A_s = a(1 + \Xi_o + v|\beta_s|)$$

where the equilibrium solution $\kappa_s$ and $\beta_s$ is given by:

$$\beta_s = \frac{M_{\kappa\kappa}N_\beta - M_{\beta\kappa}N_\kappa}{M_{\beta\beta}M_{\kappa\kappa} - M_{\beta\kappa}M_{\kappa\beta}},\ \kappa_s = \frac{M_{\beta\beta}N_\kappa - M_{\kappa\beta}N_\beta}{M_{\beta\beta}M_{\kappa\kappa} - M_{\beta\kappa}M_{\kappa\beta}}.$$

19. The method of claim 18 wherein the determination of the bitmetrics is by computing the forces on each cutter of the bit and averaging the forces over one revolution of said bit.

* * * * *